US006004731A

United States Patent [19]

Hayashi et al.

[11] Patent Number: 6,004,731

[45] **Date of Patent: *Dec. 21, 1999**

[54] PROCESSING METHOD OF SILVER HALIDE COLOR PHOTOGRAPHIC LIGHT-SENSITIVE MATERIAL AND DESILVERING PROCESSING COMPOSITION

[75] Inventors: Hiroshi Hayashi; Tetsuro Kojima; Shinichi Ichikawa, all of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/643,607

[22] Filed: May 6, 1996

[30] Foreign Application Priority Data

May 9, 1995 [JP] Japan ..... 7-134696

[51] Int. Cl.[6] ..... G03C 7/42

[52] U.S. Cl. ..... 430/372; 430/393; 430/429; 430/430

[58] Field of Search ..... 430/393, 430, 430/372, 429

[56] References Cited

U.S. PATENT DOCUMENTS 5,250,401 10/1993 Okada et al. ..... 430/393
5,300,408 4/1994 Okada et al. ..... 430/393

FOREIGN PATENT DOCUMENTS 29-26900 7/1974 Japan .
49-26140 7/1974 Japan .
55-87145 7/1980 Japan .
60-260952 12/1985 Japan .
61-4050 1/1986 Japan .
61-4054 1/1986 Japan .
61-35447 2/1986 Japan .

*Primary Examiner*—Hoa Van Le
*Attorney, Agent, or Firm*—Sughrue, Mion, Zinn, Macpeak & Seas, PLLC

[57] ABSTRACT

A method for processing a silver halide color photographic light-sensitive material comprising a support having thereon at least one light-sensitive silver halide emulsion layer, the method comprising the steps of: exposing the light-sensitive material; color developing the light-sensitive material; and desilvering the light-sensitive material, the desilvering step comprising processing the light-sensitive material with a desilvering processing solution containing at least one compound represented by formula (I) or a salt thereof:

(I)

wherein Z represents —$NR_5(R_6)$ or —$OR_7$, R represents an alkylene group, n represents 0 or 1, $R_1$, $R_2$, $R_3$, $R_4$, $R_5$ and $R_6$ each independently represents a hydrogen atom, an aliphatic group or an aromatic group, and $R_7$ represents an aliphatic group or an aromatic group, provided that any two of $R_1$, $R_2$, $R_3$ and $R_4$ may be combined with each other to form a ring, that the total carbon number of $R_5$ and $R_6$ is from 4 to 20 and that $R_5$ and $R_6$ may form a ring.

17 Claims, 1 Drawing Sheet

PROCESSING METHOD OF SILVER HALIDE COLOR PHOTOGRAPHIC LIGHT-SENSITIVE MATERIAL AND DESILVERING PROCESSING COMPOSITION

FIELD OF THE INVENTION

The present invention relates to a processing method of a silver halide color photographic light-sensitive material, more specifically, it relates to a processing method of a silver halide color photographic light-sensitive material suitable for ultra-rapid processing in a low replenishing system and causing little generation of stains and discoloration of an image after the processing or after the aging. The present invention also relates to a desilvering processing composition for use in the processing method.

BACKGROUND OF THE INVENTION

In general, the processing of a silver halide photographic light-sensitive material, for example, a silver halide color photographic light-sensitive material (hereinafter sometimes referred to as "light-sensitive material"), comprises a color development step and a desilvering step. In the desilvering step, the developed silver produced at the color development step is oxidized (bleached) into silver salt by a bleaching agent having an oxidation action and removed together with unused silver halide from the light-sensitive layer by a fixing agent which forms a soluble silver. As the bleaching agent, a ferric (trivalent) ion complex salt (e.g., aminopolycarboxylic acid iron(III) complex salt) is mainly used, and as the fixing agent, a thiosulfate is usually used.

The bleaching and the fixing may be used individually as a bleaching step and a fixing step or may be conducted simultaneously as a bleach-fixing step. These processing steps are described in detail in James, *The Theory of Photographic Process,* 4th edition (1977).

The above-described processing is usually conducted in an automatic developing machine. Particularly, in recent years, a small-size developing machine called a mini lab. is installed at a shop and rapid processing service to users is being popularized. In the processing of color paper, as the developing machine is miniaturized and the rapid processing prevails, the bleaching agent and the fixing agent are used in the same bath as a bleach-fixing bath. On the other hand, in the above-described processing, for the purpose of resource saving and environmental conservation, low replenishment of the processing solutions is aggressively recommended. However, if the processing is conducted merely in a low replenishment of the developer, matters dissolved out from the light-sensitive material, particularly, iodine ions or bromine ions as a strong development inhibitor accumulate to reduce the development activity, thereby causing a problem of failure in the rapid processing. In order to reduce the accumulation of iodine ions or bromine ions and to achieve rapid processing, JP-A-58-95345 (the term "JP-A" as used herein means an "unexamined published Japanese patent application") I JP-A-59-2323442, JP-A-61-70552 and WO87-04534 disclose a method of using a silver halide light-sensitive material having a high silver chloride content and this is considered to be an effective technique for achieving rapid processing in a low replenishing system of the developer.

JP-A-4-443 describes the processing of a silver halide light-sensitive material having a high silver chloride content with a color developer containing a hydroxyalkyl-substituted p-phenylenediamine derivative having a specific structure, whereby the dye image can be excellent in the stability and the low replenishment and the ultra-rapid processing can be achieved.

Further, the bleach-fixing is also being demanded to be greatly expedited and improved in the solution stability. However, if a short-time bleach-fixing is conducted after the rapid color development, the developing agent which is conventionally removed in the bleach-fixing step or the sensitizing dye or the dye for preventing halation used in the light-sensitive material cannot be removed sufficiently and as a result, stains on an image after the processing, namely, blurs on the white background of an image are generated to trash the image as cannot endure viewing. Accordingly, a desilvering processing composition and a processing method capable of overcoming the above-described problems have been keenly demanded.

In the processing of a silver halide light-sensitive material containing silver chlorobromide or silver iodobromide, an onium salt represented by a quaternary ammonium salt or an organic base taking a conjugate acid has been conventionally used in the bleaching bath as a bleaching accelerator so as to accelerate the desilvering as described in JP-A-49-84440, JP-A-61-151147, JP-A-62-129854, JP-A-62-135833, JP-A-1-211757 and JP-A-1-213653. As described in JP-A-1-211757, the bleaching accelerator is useful particularly in processing a color reversal light-sensitive material for photographing or color negative light-sensitive material for photographing using a high silver amount emulsion.

However, in these patent publications, a method for rapidly removing or accelerating the removal of a developing agent or a coloring material such as a sensitizing dye or a dyestuff is not known. Further, it has been found that some desilverization accelerators deteriorate the image stability when the water washing or stabilization processing time is reduced and they are unsuitable for the rapid processing including water washing.

JP-A-5-303185 discloses rapid removal of a developing agent or a dye remaining in the light-sensitive material by using a bisguanidine compound. The bisguanidine compound may surely remove a developing agent or a dye remaining in the light-sensitive material to a certain degree, which is, however, not satisfactory, and the compound is still bound to a problem of discoloration generated when the processed light-sensitive material is stored under a high temperature and a high humidity, hence, an improvement is demanded.

In JP-B-49-26140 (the term "JP-B" as used herein means an "examined Japanese patent publication"), JP-B-49-26900, JP-A-55-87145, JP-A-60-260952, JP-A-61-4050, JP-A-61-4054 and JP-A-61-35447, other guanidine compound is added to a developer or a stabilization solution, however, any compound is insufficient in the removal of a developing agent or a dye remaining in the light-sensitive material and bound to a problem of generation of stains, hence, an improvement is demanded.

SUMMARY OF THE INVENTION

Accordingly, an object of the present invention is to provide a method for processing a silver halide color photographic light-sensitive material, wherein the remaining of a color developing agent in the processed light-sensitive material is remarkably reduced even when the silver halide color photographic material is subjected to ultra-rapid processing in a low replenishing system, stains are little generated even after a long-term storage and an image undergoing less discoloration can be provided even if it is stored under a high temperature and a high humidity.

Another object of the present invention is to provide a desilvering processing composition suitable for ultra-rapid processing with a low replenishing amount, capable of reducing the remaining of a developing agent in the processed light-sensitive material, causing little stains on the white background and capable of providing a color image undergoing less discoloration even after storage under high temperature and high humidity conditions.

Other objects and effects of the present invention will be apparent from the following description.

The term "stain" as used herein is in one meaning the coloration on the white background generated resulting from the reaction of a color developing agent remaining in the processed light-sensitive material during storage (for example, aged storage under high humidity) or due to the coloring material such as a sensitizing dye or a dyestuff in the light-sensitive material remained immediately after the processing.

As a result of extensive investigations, the present inventors have found that when a compound such as a monoguanidine is used in a desilvering bath in the processing, such as a bleaching bath or a bleach-fixing bath, the coloring material such as a color developing agent or a dye can be rapidly washed out and based on this finding, the present inventors have made further investigations and accomplished the present invention.

The above-described objects can be achieved by the following methods.

(1) A method for processing a silver halide color photographic light-sensitive material comprising a support having thereon at least one light-sensitive silver halide emulsion layer, the method comprising the steps of: exposing the light-sensitive material; color developing the light-sensitive material; and desilvering the light-sensitive material, the desilvering step comprising processing the light-sensitive material with a desilvering processing solution containing at least one compound represented by formula (I) or a salt thereof:

(I)

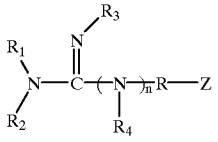

wherein Z represents —$NR_5(R_6)$ or —$OR_7$, R represents an alkylene group, n represents 0 or 1, $R_1$, $R_2$, $R_3$, $R_4$, $R_5$ and $R_6$ each independently represents a hydrogen atom, an aliphatic group or an aromatic group, and $R_7$ represents an aliphatic group or an aromatic group, provided that any two of $R_1$, $R_2$, $R_3$ and $R_4$ may be combined with each other to form a ring, that the total carbon number of $R_5$ and $R_6$ is from 4 to 20 and that $R_5$ and $R_6$ may form a ring.

(2) A method for processing a silver halide color photographic light-sensitive material as described in item (1), wherein the silver halide color photographic light-sensitive material is processed in the presence of a stilbene fluorescent brightening agent;

(3) A method for processing a silver halide color photographic light-sensitive material as described in item (1) or (2), wherein the total processing time from the initiation of development to the completion of drying is from 10 to 120 seconds, a color developer contains a developing agent in an amount of from 12 to 200 mmol/l and a color development temperature is from 40 to 50° C.;

(4) A method for processing a silver halide color photographic light-sensitive material as described in item (1) or (2), wherein the light-sensitive silver halide emulsion layer comprises silver halide grains having a silver chloride content of 98 mol % or more, the silver halide color photographic light-sensitive material has a hydrophilic colloid coverage of from 2 to 6.8 g/$m^2$ and an alkali consumption of from 1.0 to 2.9 mmol/$m^2$, and the color development processing time is from 5 to 30 seconds; and (5) A desilvering processing composition containing a compound represented by formula (I) described in item (1) or a salt thereof.

BRIEF DESCRIPTION OF THE DRAWING

FIGURE is a schematic view showing one embodiment of a silver salt photographic color paper processing machine to which the present invention is applied.

DETAILED DESCRIPTION OF THE INVENTION

Figure 1:
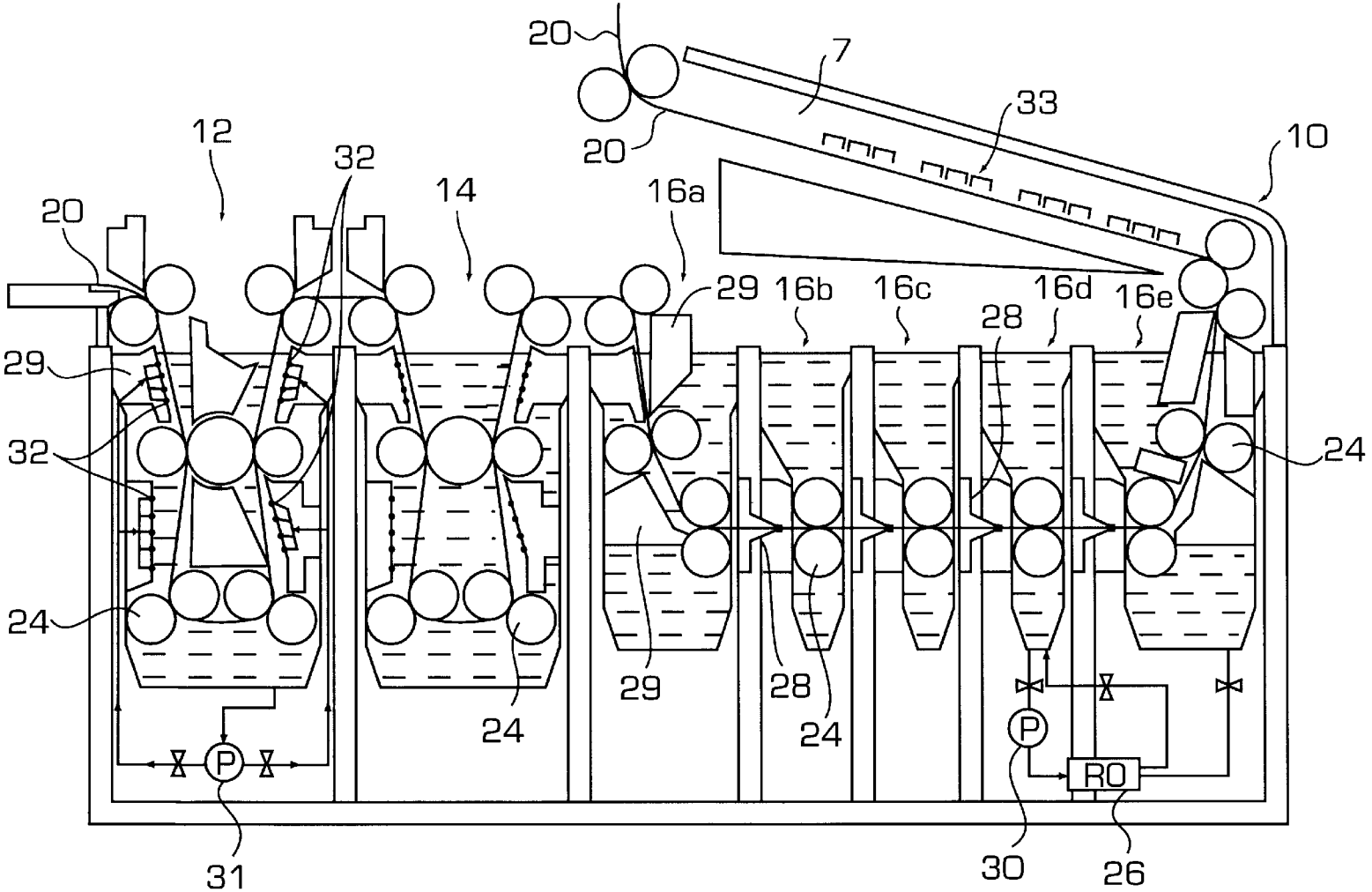

According to the processing method using a specific monoguanidine compound represented by formula (I) or a salt thereof of the present invention, the removal of a color developing agent and a coloring material such as a sensitizing dye or a dyestuff from the light-sensitive material can be satisfactorily accelerated even in the low-replenishment and ultra-rapid processing and not only the problem of deterioration on the white background of an image due to stains generated by the compound remained is overcome but also an image free of discoloration can be obtained even when the processed light-sensitive material is stored for a long period of time under high temperature and high humidity conditions.

Further, it is very unexpected to find that only the above-described specific monoguanidine compound can evade the worsening in the image stability even in a short-time water washing and/or stabilization processing after desilvering and reduce the generation of stains and discoloration of the image after the processing or aging. It is also found that the generation of stains or discoloration after the processing which is readily caused at rapid processing with a low replenishing amount, can be reduced when a compound such as the above-described monoguanidine is used in the desilvering bath. The compound provides almost no desilverization acceleration effect within the desilvering time of 20 seconds or less, which is greatly different from the situation described in JP-A-1-211757.

As described in the foregoing, in processing a silver halide color photographic light-sensitive material with a desilvering solution, addition of various compounds such as a bleaching accelerator to the processing solution has been conventionally proposed but very a part of the compounds is tested and with respect to a major part of the compounds, no specific compound is described, none of them is tested and the capability of them is not verified at all.

In the present invention, a working effect such that a color developing agent or a coloring material such as a dyestuff or a sensitizing dye can be very satisfactorily washed out when the processing is conducted in practice using a desilvering processing solution containing a specific guanidine, is first found and put into practical use. This processing technique has been hitherto not used at all but it is first conducted in the present invention, and as a result, the above-described effect can be achieved at the first time in the present invention.

Furthermore, it is found that when in combination with the processing with a desilvering processing solution using a specific monoguanidine, the light-sensitive material is processed in the presence of a stilbene fluorescent brightening agent, the removal of a coloring material such as a sensitizing dye in the light-sensitive material is surprisingly greatly accelerated. In this case, the fluorescent brightening agent may be added to a desilvering solution, it may be added to a developer to permeate into a light-sensitive material which is then processed with a desilvering solution containing a monoguanidine, or the fluorescent brightening agent may be previously incorporated into a light-sensitive material; in any case, it is found that the removal of a coloring material such as a sensitizing dye in the light-sensitive material can be sufficiently accelerated.

In a preferred embodiment of the processing method of the present invention, the total processing time of from the initiation of development to the completion of drying is from 10 to 120 seconds, the amount of the developing agent in the color developer is from 12 to 120 mmol/l and the color developing temperature is from 40 to 50° C., whereby an ultra-rapid processing can be conducted and the above-described generation of stains or discoloration after the processing or aging can be prevented. The desilvering processing time is preferably within 20 seconds.

In another preferred embodiment of the processing method of the present invention, the above-described light-sensitive silver halide emulsion layer comprises silver halide grains having a silver chloride content of 98 mol % or more, the silver halide color photographic material has a hydrophilic colloid coverage of from 2 to 6.8 g/$m^2$ and an alkali consumption of from 1.0 to 2.9 mmol/$m^2$, and the color developing processing time is from 5 to 30 seconds, whereby an ultra-rapid processing in a low replenishing system can be achieved and the above-described generation of stains or discoloration after the processing or aging can be prevented. In the present invention, the processing time means the residence time of the light-sensitive material in the processing solutions.

In the processing method of the present invention, the above-described effect can be provided even under a low replenishing amount condition. The replenishing amount of each of the developer and the desilvering processing solution, such as the bleach-fixing solution, the bleaching solution or the fixing solution is preferably 120 ml/$m^2$ or less, more preferably from 15 to 60 ml/$m^2$. A replenishment-free processing (including the case where the water content evaporated is replenished) is also one of the preferred embodiments.

It is further found that by using a desilvering processing composition containing the compound represented by formula (I) or its salt, even in the case of low-replenishing ultra-rapid processing, the effect to remove a developing agent, a dye or a coloring material such as a sensitizing dye or a dyestuff can be satisfactorily accelerated and not only the problem of deterioration on the white background of an image due to stains caused by the remaining of the compounds can be overcome but also an image free of discoloration can be obtained even when the light-sensitive material after the processing is stored for a long period of time under high temperature and high humidity conditions.

In the present invention, the processing composition means a composition for use in the processing of a light-sensitive material and examples thereof include a developing composition and a bleaching composition.

The compound represented by formula (I) for use in the present invention is described in detail below.

In formula (I), Z represents —$NR_5(R_6)$ or —$OR_7$, the total carbon number of $R_5$ and $R_6$ is from 4 to 20 and $R_5$ and $R_6$ may form a ring. Examples of the ring formed by $R_5$ and $R_6$ include a piperidine ring, a 2-methylpiperidine ring, a 2,6-dimethylpiperidine ring, a 2,2,6,6-tetramethylpiperidine ring, a pyrrolidine ring, a 2-methylpyrrolidine ring and a 4-benzylpiperidine ring.

R is preferably an alkylene group having from 2 to 10 carbon atoms and specific examples thereof include an ethylene group, a propylene group and a hexylene group.

In formula (I), the aliphatic group represented by. $R_1$, $R_2$, $R_3$, $R_4$, $R_5$, $R_6$ or $R_7$ is preferably an aliphatic group having from 1 to 10 carbon atoms, more preferably a linear, branched or cyclic alkyl, alkenyl, alkynyl or aralkyl group having from 1 to 7 carbon atoms. Examples of the alkyl group, the alkenyl group, the alkynyl group and the aralkyl group include a methyl group, an ethyl group, an isopropyl group, a t-butyl group, an n-octyl group, an n-decyl group, an n-hexadecyl group, a cyclopropyl group, a cyclopentyl group, a cyclohexyl group, an allyl group, a 2-butenyl group, a 3-pentenyl group, a propargyl group, a 3-pentynyl group and a benzyl group.

In formula (I), the aromatic group represented by $R_1$, $R_2$, $R_3$, $R_4$, $R_5$, $R_6$ or $R_7$ is preferably an aromatic group having from 6 to 12 carbon atoms, more preferably a monocyclic or condensed ring aryl group having from 6 to 8 carbon atoms, and examples thereof include a phenyl group and a naphthyl group.

Any two groups of $R_1$, $R_2$, $R_3$ and $R_4$ may be combined with each other to form a ring. Examples of the ring include a piperidine ring, a 2-methylpiperidine ring, a 2,6-dimethylpiperidine ring, a 2,2,6,6-tetramethylpiperidine ring, a pyrrolidine ring, a 2-methylpyrrolidine ring and a 4-benzylpiperidine ring.

In formula (I), the groups represented by $R_1$, $R_2$, $R_3$, $R_4$, $R_5$, $R_6$ and $R_7$ each may be substituted. Examples of the substituent include the following:

A halogen atom (e.g., fluorine, chlorine, bromine), an alkyl group (e.g., methyl, ethyl, n-propyl, isopropyl, t-butyl, n-octyl, cyclopentyl, cyclohexyl), an alkenyl group (e.g., allyl, 2-butenyl, 3-pentenyl), an alkynyl group (e.g., propargyl, 3-pentynyl), an aralkyl group (e.g., benzyl, phenethyl), an aryl group (e.g., phenyl, naphthyl, 4-methylphenyl), an alkoxy group (e.g., methoxy, ethoxy, butoxy), an aryloxy group (e.g., phenoxy, 2-naphthyloxy), an acylamino group (e.g., acetylamino, benzoylamino), a ureido group (e.g., unsubstituted ureido, N-methylureido, N-phenylureido), a urethane group (e.g., methoxycarbonylamino, phenoxycarbonylamino), a sulfonylamino group (e.g., methylsulfonylamino, phenylsulfonylamino), a sulfamoyl group (e.g., unsubstituted sulfamoyl, N,N-dimethylsulfamoyl, N-phenylsulfamoyl), a carbamoyl group (e.g., unsubstituted carbamoyl, N,N-diethylcarbamoyl, N-phenylcarbamoyl), a sulfonyl group (e.g., mesyl, tosyl), a sulfinyl group (e.g., methylsulfinyl, phenylsulfinyl), an alkyloxycarbonyl group (e.g., methoxycarbonyl, ethoxycarbonyl), an aryloxycarbonyl group (e.g., phenoxycarbonyl), an acyl group (e.g., acetyl, benzoyl, formyl, pivaloyl), an acyloxy group (e.g., acetoxy, benzoyloxy), an alkylthio group (e.g., methylthio, ethylthio), an arylthio group (e.g., phenylthio), a cyano group, a sulfa group, a carboxy group, a hydroxy group, a phosphono group, a nitro group, a sulfino group and a phosphonio group. These groups each may further be substituted. When two or more substituents are present, they may be the same or different.

In formula (I), preferably, Z represents —$NR_5(R_6)$, R represents an alkylene group having from 2 to 6 carbon atoms, n is 1, $R_1$, $R_2$, $R_3$ and $R_4$ each represents independently a hydrogen atom or an aliphatic group having from 1 to 7 carbon atoms, $R_5$ and $R_6$ each represents independently a hydrogen atom or an aliphatic group having from 1 to 7 carbon atoms, and the total carbon number of $R_5$ and $R_6$ is from 4 to 10.

In formula (I), more preferably, $R_1$, $R_2$, $R_3$ and $R_4$ each represents independently a hydrogen atom or a lower alkalkyl group having from 1 to 4 carbon atoms, $R_5$ and $R_6$ each represents independently an alkyl group having from 1 to 6 carbon atoms, and the total carbon number of $R_5$ and $R_6$ is from 4 to 10.

In formula (I), still more preferably, $R_1$, $R_2$, $R_3$ and $R_4$ each represents a hydrogen atom, $R_5$ and $R_6$ are combined with each other to form a ring, and the total carbon number of $R_5$ and $R_6$ is from 4 to 6.

The compound represented by formula (I) may be in the form of a salt such as sulfate, hydrochloride, sulfite, naphthalenedisulfonic acid and p-toluenesulfonic acid.

Specific examples of the compound represented by formula (I) of the present invention are set forth below, but the compound of the present invention is by no means limited thereto.

1

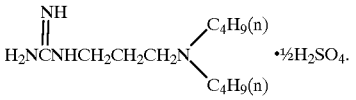

2

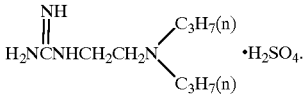

3

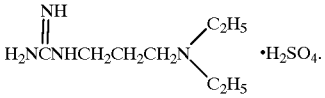

4

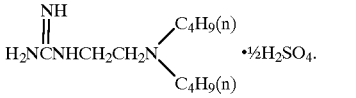

5

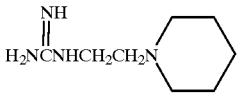

6

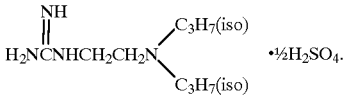

7

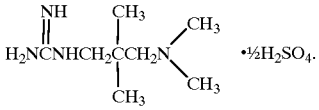

8

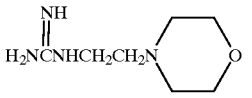

-continued

9

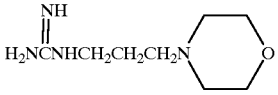

10

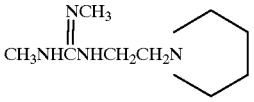

11

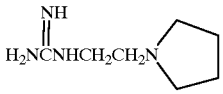

12

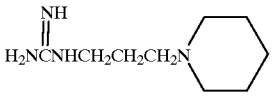

13

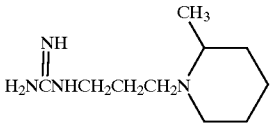

14

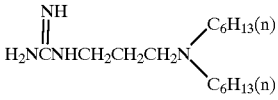

15

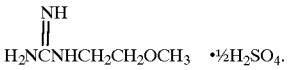

16

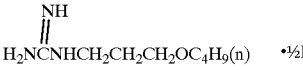

17

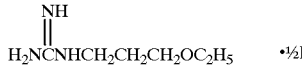

18

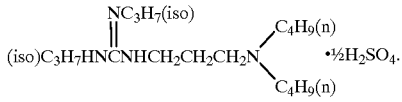

19

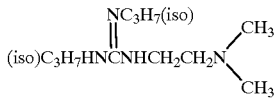

20

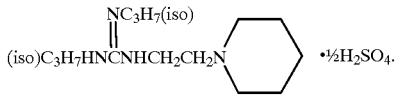

21

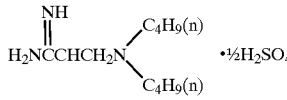

-continued

22

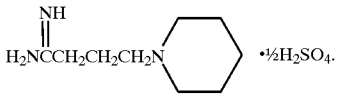

23

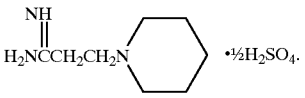

24

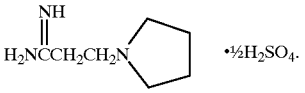

25

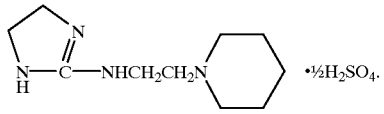

The compound represented by formula (I) can be synthesized according to a known method. The guanidines may be synthesized by referring to *Methoden der Organishen Chemie* (*Houben-Weyl*), 4th ed., Vol. 8, pp. 180–195 (1952) and *ibid.*, Vol. E4, pp. 608–624 (1983) and the amidines may be synthesized using a nitrile compound as a raw material by referring, for example, to *Organic Synthesis Collective*, Vol. 1, p. 5, John Wiley and Sons, Inc. Representative synthesis examples of the compound of the present invention are described below, but the synthesis method is not limited thereto.

SYNTHESIS EXAMPLE 1

(Synthesis of Compound 1)

To 65 ml of water, 13.9 g (0.05 mol) of S-methylisothiourea sulfate was dissolved and thereto, 18.6 g (0.1 mol) of N,N-dibutylaminopropylamine was added dropwise under nitrogen stream. After heating at 50° C. for 5 hours, the mixed solution was cooled to room temperature and the crystal deposited was collected by filtration. The resulting crude crystal was recrystallized with 50 ml of isopropyl alcohol to obtain 20.4 g (yield: 73.5%) of the objective product. The melting point was 93–94° C.

The compound obtained was verified as the objective product by NMR spectrum, IR spectrum and elementary analysis.

SYNTHESIS EXAMPLE 2

(Synthesis of Compound 5)

To 65 ml of water, 13.9 g (0.05 mol) of S-methylisothiourea sulfate was dissolved and thereto, 12.8 g (0.1 mol) of piperidinoethylamine was added dropwise under nitrogen stream. After heating at 50° C. for 5 hours, the mixed solution was cooled to room temperature and allowed to stand a whole day and night, 200 ml of acetonitrile was added thereto and the crystal deposited was collected by filtration. The crude crystal obtained was recrystallized with 50 ml of ethyl alcohol to obtain 15.0 g (yield 68.4%) of the objective product. The melting point was 201–202° C.

The resulting compound was verified as the objective product by NMR spectrum, IR spectrum and elementary analysis.

The addition amount of the compound represented by formula (I) or a salt thereof to the desilvering processing solution (desilvering processing composition) is preferably from 0.005 to 0.5 mmol/l, more preferably 0.01 to 0.1 mmol/l.

As the stilbene fluorescent brightening agent for use in the present invention, various brightening agents belonging thereto may be used. Among them, di(triazyl-amino)stilbene fluorescent brightening agents are preferred and the brightening agent represented by formula (3) is more preferred.

(3)

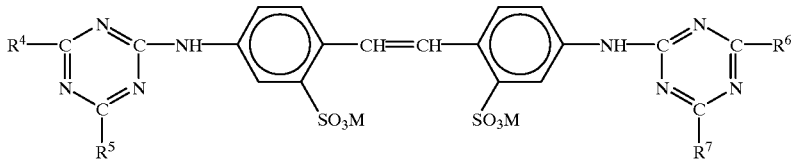

wherein $R^4$, $R^5$, $R^6$ and $R^7$ each represents independently a hydroxyl group, a halogen atom, a morpholino group, an alkyl group, an alkoxy group, an aryloxy group, an aryl group, an amino group, an alkylamino group or an arylamino group, and M represents a hydrogen atom or a cation of an alkali metal or a quaternary ammonium ion.

With respect to the specific examples of each group, examples of the halogen atom include chlorine and bromine; examples of the alkyl group include methyl, ethyl and propyl; examples of the alkoxy group include phenoxy and p-sulfophenoxy; examples of the aryloxy group include phenoxy and methoxyphenoxy; examples of the aryl group include phenyl and methoxyphenyl; examples of the alkylamino group include methylamino, ethylamino, propylamino, butylamino, dimethylamino, cyclohexylamino, β-hydroxyethylamino, di(β-hydroxyethyl)amino, β-sulfoethylamino, N-(β-sulfoethyl)-N'-methylamino and N-(β-hydroxyethyl)-N'-methylamino; and examples of the arylamino group include anilino, o-sulfoanilino, m-sulfoanilino, p-sulfoanilino, disulfoanilino, o-chloroanilino, p-chloroanilino, m-chloroanilino, o-tolyidino, m-tolyidino, p-tolyidino, o-toluidino, m-toluidino, p-toluidino, o-carboxyanilino, m-carboxyanilino, p-carboxyanilino, dicarboxyanilino, o-hydroxyalulino, m-hydroxyalulino, p-hydroxyalulino, sulfonaphthylamino, o-aminoanilino, m-aminoanilino, p-aminoanilino, o-anidino, m-anidino and p-anidino.

The cation of an alkali metal represented by M include potassium, sodium, cesium and lithium.

Preferably, $R^4$, $R^5$, $R^6$ and $R^7$ each is a methoxy group, a β-hydroxyethylamino group, a di(β-hydroxyethyl)amino group, or a sulfoethylamino, and M is sodium.

Specific examples of the stilbene fluorescent brightening agent for use in the present invention are described below, but the present invention is by no means limited thereto.

(F-1)
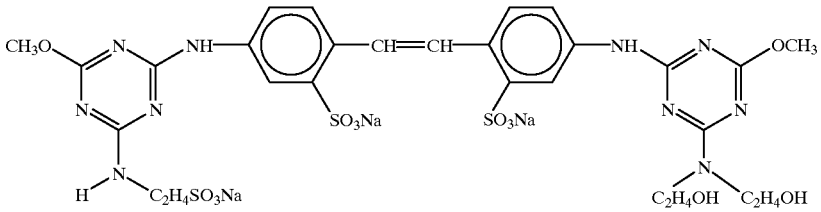
(F-2)
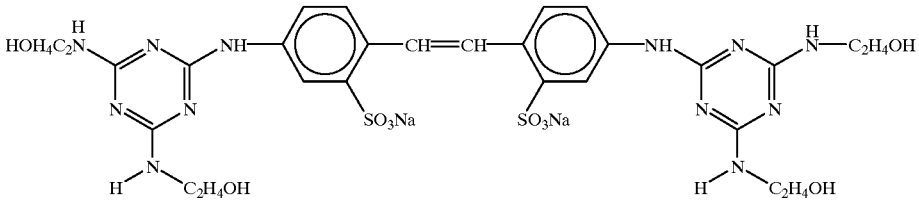
(F-3)
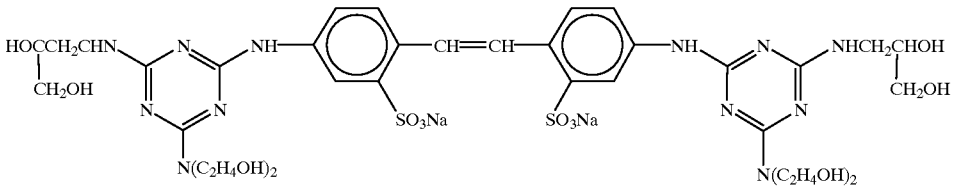
(F-4)
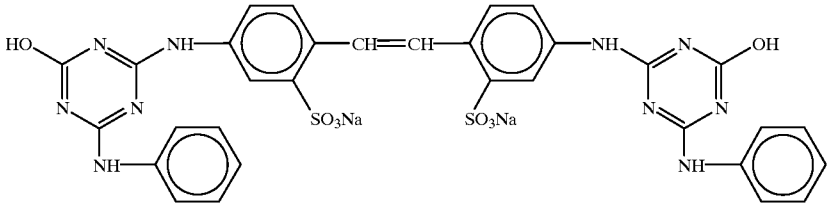
(F-5)
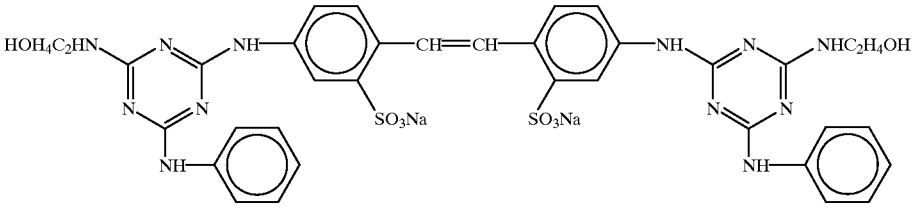
(F-6)
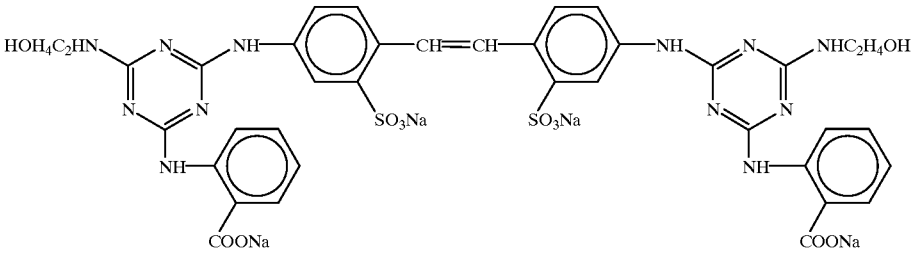

-continued
(F-7)
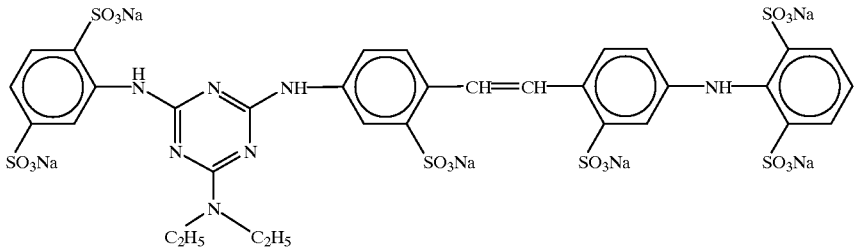
(F-8)
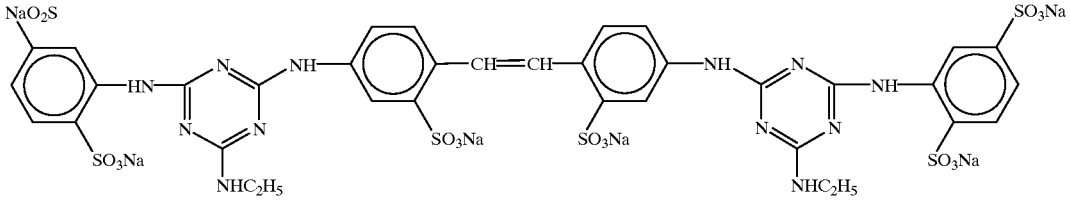
(F-9)
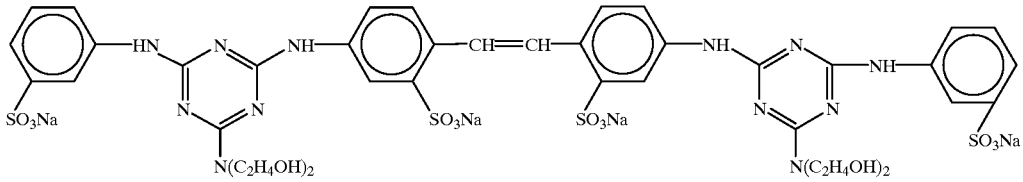
(F-10)
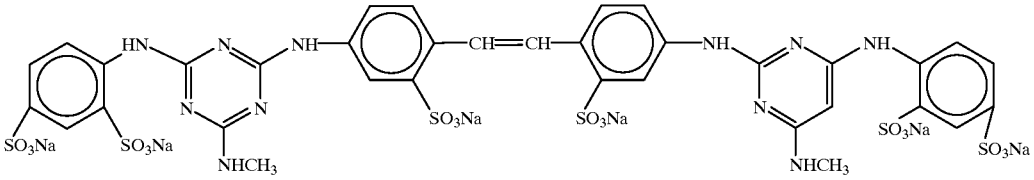
(F-11)
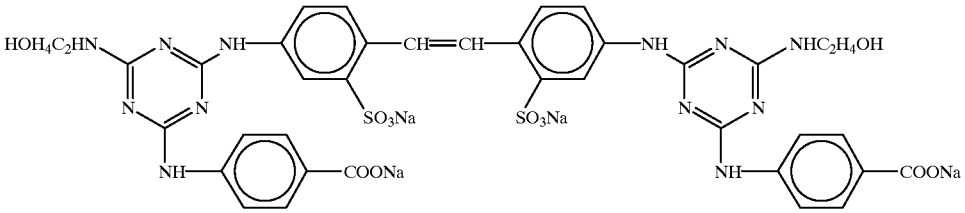
(F-12)
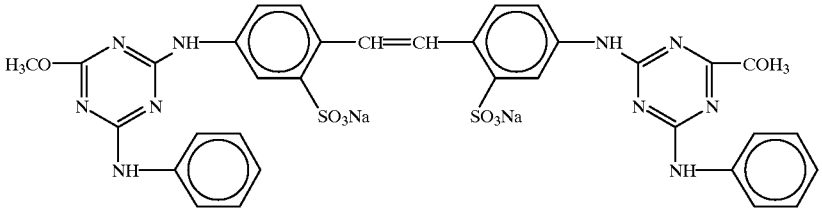
(F-13)
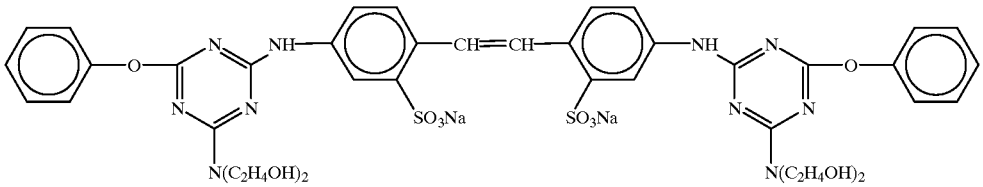

-continued (F-14)

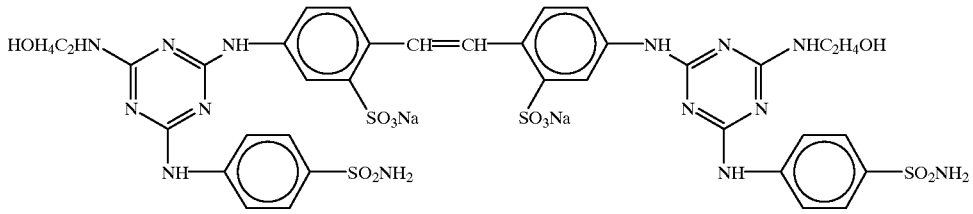

(F-15)

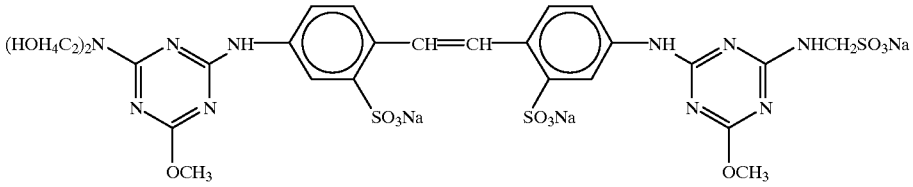

(F-16)

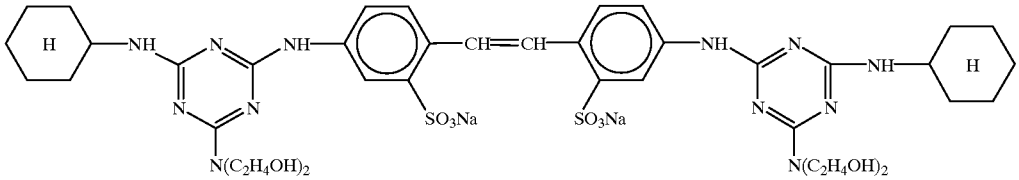

(F-17)

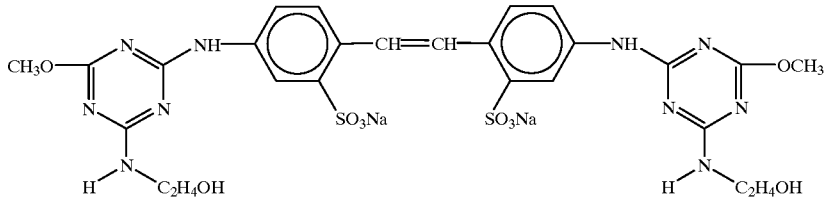

(F-18)

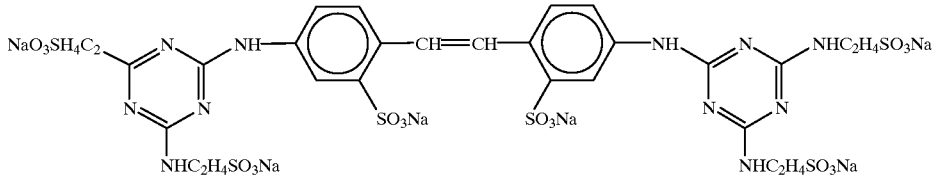

(F-19)

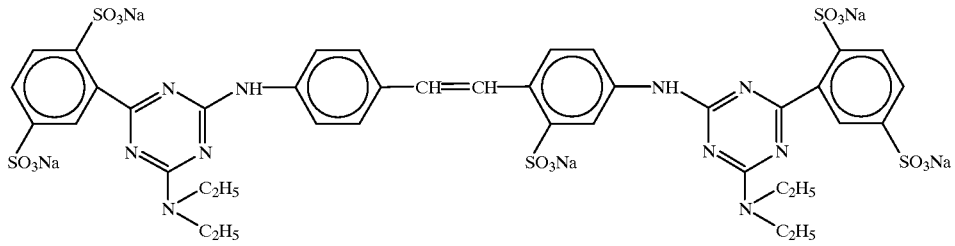

Particularly preferred stilbene fluorescent brightening agents are compounds having a structure of F-1 or F-18.

The above-described compounds all are known and easily available or easily synthesized by a known method.

When the stilbene fluorescent brightening agent is added to a desilvering solution, it is added to the desilvering solution containing the compound of formula (1) to be present therein in an amount of preferably from $1\times10^{-4}$ to $5\times10^{-2}$ mol/l, more preferably from $2\times10^{-4}$ to $1\times10^{-2}$ mol/l. The brightening agent may be added to the desilvering solution to be present therein in the above-described amount but it may also be previously incorporated into a light-sensitive material or added to the color developer to be present in the desilvering solution in the above-described amount. When the stilbene fluorescent brightening agent is previously incorporated into the light-sensitive material, the addition amount thereof is from 10 to 100 mg/m$^2$, preferably from 20 to 60 mg/m$^2$.

With respect to the light-sensitive material which can be used in the present invention, the matters particularly relevant to the present invention are described below.

In the present invention, the alkali consumption of the light-sensitive material is measured and calculated according to the following method. In calculating the alkali consumption, a certain area (specifically, 1 $m^2$) of the light-sensitive material of the present invention is sampled and the coated layer is peeled off from the support. The support is usually a paper having laminated thereon polyethylene and these layers may be peeled apart. Then the coated layer side is finely crushed and dispersed in water in a constant amount (specifically, 100 ml). Then, the solution is titrated with an alkali aqueous solution (specifically, 0.1N potassium hydroxide solution) and the amount of potassium hydroxide required for the pH to increase from 6.0 to 10.0 is defined as an alkali consumption in a mmol unit.

When the support contains an acid component and the layers cannot be peeled apart, the evaluation may be made by subtracting the value determined only on the support.

The alkali consumption is an index for evaluating the acid component contained in the light-sensitive material and the pH buffering ability of the component. The alkali consumption is practically affected by gelatin as a hydrophilic binder in the light-sensitive material or other organic compounds.

In order to achieve the effect of the present invention, the alkali consumption is preferably 2.9 mmol/$m^2$ or less. The lower limit is determined by the amount of the hydrophilic binder required to at least hold the light-sensitive material and in practice, the lower limit of the alkali consumption is 1.0 mmol/$m^2$ or more. The alkali consumption is more preferably from 1.5 to 2.6 mmol/$m^2$.

In the present invention, the coating amount of the hydrophilic colloid in the light-sensitive material is preferably from 6.8 g/$m^2$ or less, more preferably from 2 to 6.8 g/$m^2$, still more preferably from 4 to 6.5 g/$m^2$.

With respect to the processing specification which can be used in the present invention, the matters particularly relevant to the present invention are described below.

The present invention intends to achieve the processing including rapid development where the color development time is preferably 30 seconds or less. As long as the above-described rapid development can be conducted, the processing conditions such as the pH and the temperature may be freely set. In general, the pH is 10.0 or more and the temperature is 30° C. or higher, however, in order to achieve stably and firmly the rapid development, preferably, the pH is 10.20 or more and the temperature is 40° C. or higher. The upper limit of the pH is generally about 12 in view of stabilization of the processing and capability of the buffer solution. The upper limit of the temperature is determined by evaporation, oxidation and safety of the solution and it is generally 55° C. or lower. More preferably, the pH is from 10.20 to 11.5 and the temperature is from 40 to 50° C.

In the present invention, the total processing time of from initiation of the development and completion of the drying is preferably 120 seconds or less, more preferably from 10 to 100 seconds, still more preferably from 30 to 90 seconds.

The irradiation inhibiting dye for use in the present invention may be any which can be commonly used in the photographic light-sensitive material, however, particularly in the rapid processing, when a dye having a high removal speed and a large irradiation preventing effect (as a result, the use amount is reduced) is used, the effectiveness as the total system is elevated. A particularly preferred compound is a pyrazolone-pentamethine oxonol compound.

Particularly preferred specific examples of the compound are set forth below.

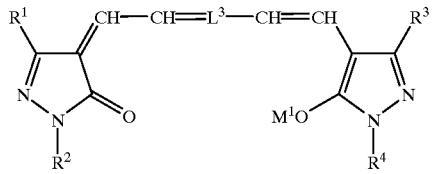

| | $R^1$, $R^3$ | $R^2$, $R^4$ | $L^3$ | $M^1$ |
|---|---|---|---|---|
| D-1 | $C_2H_5OCO$— | 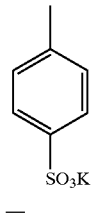 | ═CH— | H |
| D-2 | $C_2H_5OCO$— | 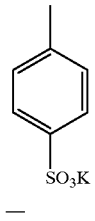 | 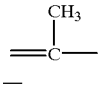 | H |

-continued
| | | | | |
|---|---|---|---|---|
| D-3 | $C_2H_5OCO$— | 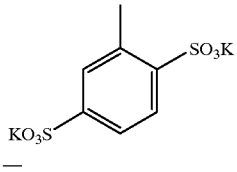 | =CH— | K |
| D-4 | $C_2H_5OCO$— | 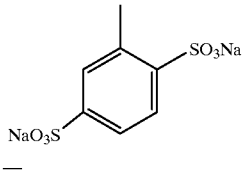 | 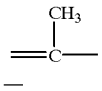 | Na |
| D-5 | 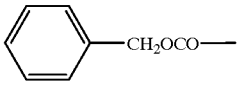 | 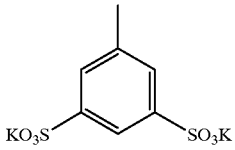 | =CH— | H |
| D-6 | $CH_3OCO$— | 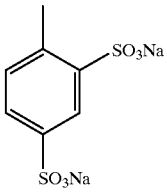 | 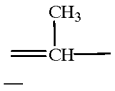 | Na |
| D-7 | $C_2H_5OCO$— | 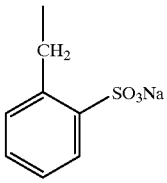 | =CH— | H |
| D-8 | $CH_3OCO$— | 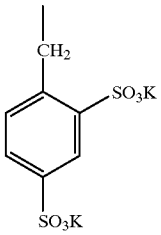 | 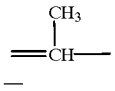 | K |
| D-9 | 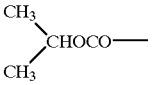 | 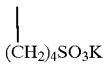 | =CH— | K |
| D-10 | 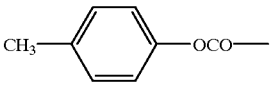 | 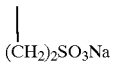 | 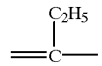 | H |

-continued
| | | | | |
|---|---|---|---|---|
| D-11 | $CH_3OCO$— | 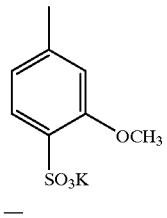 | 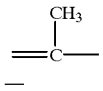 | K |
| D-12 | 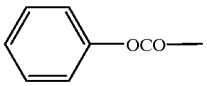 | 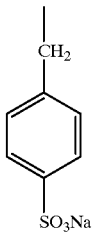 | =CH— | H |
| D-13 | $C_2H_5OCO$— | 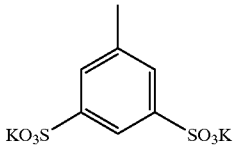 | 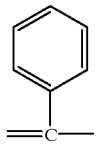 | H |
| D-14 | $CH_3CO$— | 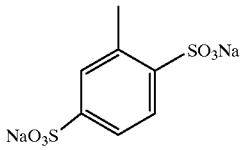 | =CH— | Na |
| D-15 | $CH_3CO$— | 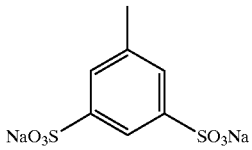 | =CH— | Na |
| D-16 | 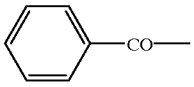 | 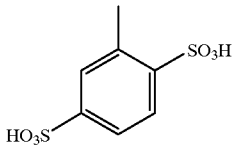 | =CH— | H |
| D-17 | $CH_3CO$— | 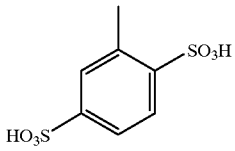 | 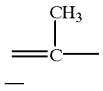 | H |
| D-18 | 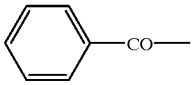 | 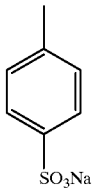 | 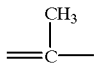 | Na |

-continued

| | | | | |
|---|---|---|---|---|
| D-19 | $CH_3CO$— | $(CH_2)_4SO_3Na$ — | =CH— | Na |
| D-20 | $KO_3S$ CO— $KO_3S$ | $SO_3K$ | =CH— | H |
| D-21 | $KO_3S$— CO— | $CH_2$— $SO_3K$ | $CH_3$ =C— | K |
| D-22 | $CH_3CO$— | $SO_3K$ — | $CH_3$ =C— — | H |
| D-23 | $C_4H_9CO$— | $SO_3Na$ $NaO_3S$ — | =CH— | Na |
| D-24 | $C_5H_{11}CO$— | $(CH_2)_3SO_3K$ — | =CH— | K |
| D-25 | $CH_3CO$— | $CH_2$ $SO_3Na$ — | $CH_2CH_2SO_3Na$ =C— — | H |
| D-26 | $CH_3CO$— | $SO_3Na$ — | $CH_2CH_2SO_3Na$ =C— — | Na |

-continued
| | | | | |
|---|---|---|---|---|
| D-27 | (t)$C_4H_9CO$— | 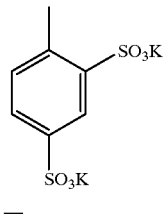 | 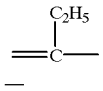 | K |
| D-28 | $C_2H_5CO$— | 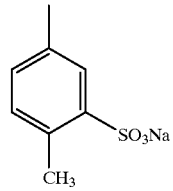 | 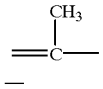 | Na |
| D-29 | HOOC— | 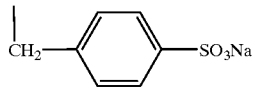 | 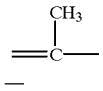 | H |
| D-30 | NaOOC— | 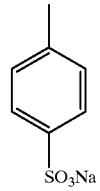 | ═CH— | Na |
| D-31 | KOOC— | 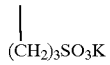 | ═CH— | K |
| D-32 | HOOC— | 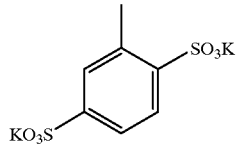 | 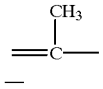 | H |
| D-33 | KOOC— | 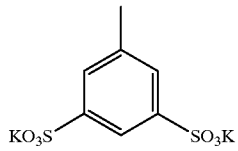 | 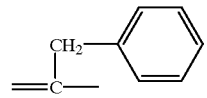 | K |
| D-34 | $HOCH_2CH_2NHCO$— | 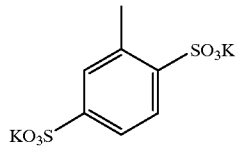 | ═CH— | H |

-continued
| | | | | |
|---|---|---|---|---|
| D-35 | $HOCH_2CH_2NHCO$— | 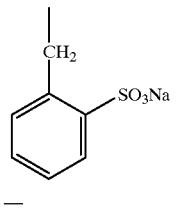 | 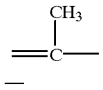 | Na |
| D-36 | $CH_3NHCO$— | 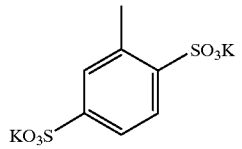 | 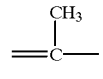 | K |
| D-37 | 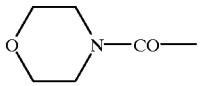 | 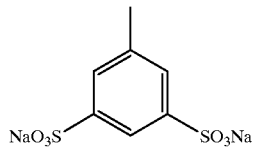 | =CH— | Na |
| D-38 | $H_2NCO$— | 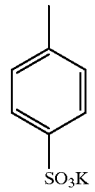 | 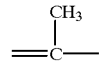 | K |
| D-39 | 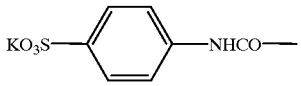 | 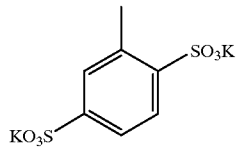 | =CH— | H |
| D-40 | $CH_3NHCO$— | 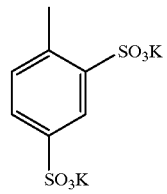 | 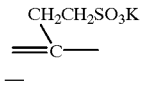 | K |
| D-41 | $HOOCCH_2NHCO$— | 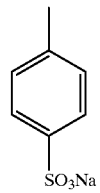 | =CH— | H |
| D-42 | $H_2NCO$— | 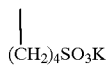 | 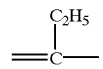 | K |

-continued
| | | | | |
|---|---|---|---|---|
| D-43 | 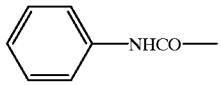 | 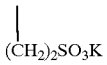 | 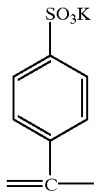 | K |
| D-44 | NC— | 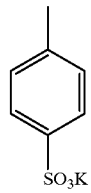 | =CH— | H |
| D-45 | NC— | 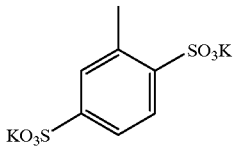 | 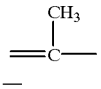 | K |
| D-46 | NC— | 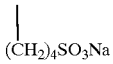 | =CH— | Na |
| D-47 | 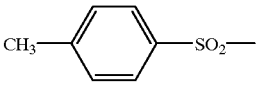 | 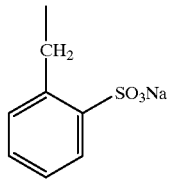 | 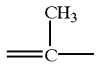 | H |
| D-48 | $CH_3SO_2$— | 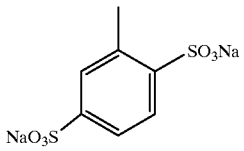 | 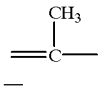 | Na |
| D-49 | 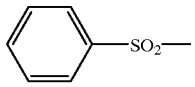 | 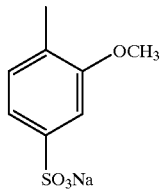 | =CH— | Na |
| D-50 | $C_4H_9SO_2$— | 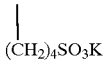 | =CH— | K |

-continued

| | | | | | |
|---|---|---|---|---|---|
| D-51 | $CH_3SO_2$— | 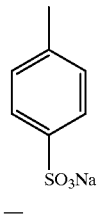 | 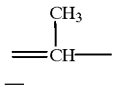 | | H |
| D-52 | $C_2H_5NHSO_2$— | 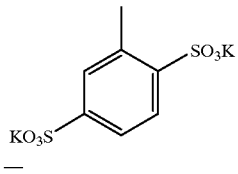 | =CH— | | K |

| | $R^1$ | $R^3$ | $R^2$ | $R^4$ | $L^3$ | $M^1$ |
|---|---|---|---|---|---|---|
| D-53 | $CH_3SO_2$— | $H_2NCO$— | 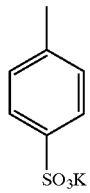 | 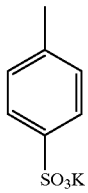 | =CH— | H |
| D-54 | $HOCH_2CH_2SO_2$— | $CH_3CO$— | 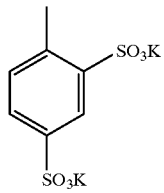 | 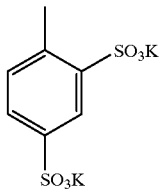 | =CH— | K |
| D-55 | $H_2NSO_2$— | $H_2NCO$— | 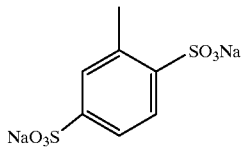 | 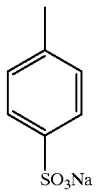 | 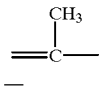 | Na |
| D-56 | $C_2H_5OCO$— | $C_2H_5OCO$— | 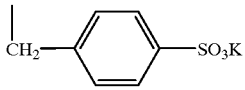 | 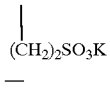 | =CH— | K |

The addition amount of the irradiation inhibiting dye is preferably from 0.01 to 0.20 mol, more preferably from 0.02 to 0.15 mol, per $m^2$ of the light-sensitive material. The layer where the irradiation inhibiting dye is added may be any layer irrespective of an emulsion layer or an interlayer.

The method of the present invention is specifically described by taking as one example, the case of a silver halide color photographic light-sensitive material which is preferably used in the present invention.

The processing method which can be used in the present invention is described below.

The processing method of the present invention specifically comprises color development and desilvering, usually followed by water washing and/or stabilization and drying.

In the present invention, a color developer is used as the developer.

The color developer for use in the present invention contains a known aromatic primary amine color developing agent and preferred examples thereof include p-phenylenediamine derivatives. Representative examples of the p-phenylenediamine derivative are described below, but the present invention is by no means limited thereto.

| | |
|---|---|
| d-1 | N, N-Diethyl-p-phenylenediamine |
| d-2 | 4-Amino-N,N-diethyl-3-methylaniline |
| d-3 | 4-Amino-N-(β-hydroxyethyl)-N-methylaniline |
| d-4 | 4-Amino-N-ethyl-N-(β-hydroxyethyl)aniline |
| d-5 | 4-Amino-N-ethyl-N-(β-hydroxyethyl)-3-methylaniline |
| d-6 | 4-Amino-N-ethyl-N-(3-hydroxypropyl)-3-methylaniline |
| d-7 | 4-Amino-N-ethyl-N-(4-hydroxybutyl)-3-methylaniline |
| d-8 | 4-Amino-N-ethyl-N-(β-methanesulfonamidoethyl)-3-methylaniline |
| d-9 | 4-Amino-N,N-diethyl-3-(β-hydroxyethyl)aniline |
| d-10 | 4-Amino-N-ethyl-N-(β-methoxyethyl)-3-methylaniline |
| d-11 | 4-Amino-N-(β-ethoxyethyl)-N-ethyl-3-methylaniline |
| d-12 | 4-Amino-N-(3-carbamoylpropyl)-N-n-propyl-3-methyl-aniline |
| d-13 | 4-Amino-N-(4-carbamoylbutyl)-N-n-propyl-3-methylaniline |
| d-14 | N-(4-Amino-3-methylphenyl)-3-hydroxypyrrolidine |
| d-15 | N-(4-Amino-3-methylphenyl)-3-(hydroxymethyl)pyrrolidine |
| d-16 | N-(4-Amino-3-methylphenyl)-3-pyrrolidine carboxamide |

Among the above-described p-phenylenediamine derivatives, particularly preferred are Compounds d-5, d-6, d-7, d-8 and d-12. The p-phenylenediamine derivative may be used as a salt such as sulfate, hydrochloride, sulfite, naphthalenedisulfonate or p-toluenesulfonate. The use amount of the aromatic primary amine developing agent is preferably from 2 to 200 mmol, more preferably from 12 to 200 mmol, still more preferably from 12 to 150 mmol, per l of the developer.

In practicing the present invention, a developer containing substantially no benzyl alcohol is preferably used. The term "containing substantially no benzyl alcohol" as used herein means that the benzyl alcohol concentration is preferably 2 ml/l or less, more preferably 0.5 ml/l or less and most preferably, the benzyl alcohol is not contained at all.

The developer for use in the present invention preferably contains substantially no sulfite ion. The sulfite ion has a function as a preservative of the developing agent but at the same time, it has an action to dissolve silver halide or to reduce the dye formation efficiency due to the reaction with the oxidation product of the developing agent. The above-described actions of the sulfite ion are deemed to be one of causes to increase the change in the photographic properties accompanying the continuous processing. The term "contains substantially no sulfite ion" as used herein means that the sulfite ion concentration is preferably $3.0\times10^{-3}$ mol/l or less, and most preferably, the sulfite ion is not contained at all. However, in the present invention, a very slight amount of sulfite ions used for preventing oxidation of a processing agent kit where the developing agent before the preparation of a solution for practical use is concentrated is excluded.

The developer for use in the present invention preferably contains substantially no sulfite ion and further it preferably contains substantially no hydroxylamine. This is because the hydroxylamine has a function as a preservative of the developer but at the same time, it exhibits by itself silver developing activity and the change in the concentration of hydroxylamine is deemed to greatly affect the photographic properties. The term "contains substantially no hydroxylamine" as used herein means that the hydroxylamine concentration is preferably $5.\times10^{-3}$ mol/l or less and most preferably, the hydroxylamine is not contained at all.

The developer for use in the present invention preferably contains an organic preservative in place of the above-described hydroxylamine or sulfite ion.

The organic preservative as used herein includes organic compounds in general capable of reducing the deterioration rate of an aromatic primary amine color developing agent when it is added to the processing solution of the light-sensitive material. More specifically, organic compounds having a function to prevent oxidation of a color developing agent due to air or the like may be used and among these, particularly effective organic preservatives are hydroxylamine derivatives (excluding hydroxylamine, hereinafter the same), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and condensed ring amines. These compounds are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496.

As other preservatives, various metals described in JP-A-57-44148 and JP-A-57-53749, salicylic acids described in JP-A-59-180588, alkanolamines described in JP-A-54-3532, polyethyleneimines described in JP-A-56-94349 or aromatic polyhydroxy compounds described in U.S. Pat. No. 3,746,544 may be added, if desired. In particular, an alkanolamine such as triethanolamine, a dialkylhydroxylamine such as diethyl-hydroxylamine, a hydrazine derivative or an aromatic polyhydroxy compound is preferably added.

Among the above-described organic preservatives, hydroxylamine derivatives and hydrazine derivatives (e.g., hydrazines, hydrazides) are particularly preferred and these are described in detail in JP-A-1-97953, JP-A-1-186939, JP-A-1-186940 and JP-A-1-187557.

The above-described hydroxylamine derivative or hydrazine derivative is preferably used in combination with an amine so as to improve stability of the color developer and accordingly, to improve stability in a continuous processing.

The above-described amines include cyclic amines described in JP-A-63-239447, amines described in JP-A-63-128340 and amines described in JP-A-1-186939 and JP-A-1-187557.

In the processing of the present invention, the color developer preferably contains chlorine ions in an amount of from $3.5\times10^{-2}$ to $1.5\times10^{-1}$ mol/l, preferably from $4\times10^{-2}$ to $1\times10^{-1}$ mol/l. If the chlorine ion concentration exceeds $1.5\times10^{-1}$ mol/l, the development is disadvantageously retarded to hinder achieving rapid processing and high maximum density, whereas if it is less than $3.5\times10^{-2}$ mol/l, not preferred results come out in view of the prevention of fog.

In the processing of the present invention, the bromine ion concentration in the color developer is preferably $1.0\times10^{-3}$ mol/l, more preferably $5\times10^{-4}$ mol/l. If the bromine ion concentration exceeds $1\times10^{-3}$ mol/l, the development is retarded and the maximum density and the sensitivity are reduced.

The chlorine ion or the bromine ion may be added directly to the developer or may be dissolved out from the light-sensitive material to the developer during development processing.

When the above-described ion is added directly to the color developer, the chlorine ion-supplying material includes sodium chloride, potassium chloride, ammonium chloride, lithium chloride, nickel chloride, magnesium chloride, manganese chloride, calcium chloride and cadmium chloride, and among these, preferred are sodium chloride and potassium chloride. The ion may be supplied from the fluorescent brightening agent added to the developer.

The bromine ion-supplying material includes sodium bromide, potassium bromide, ammonium bromide, lithium bromide, calcium bromide, magnesium bromide, manganese bromide, nickel bromide, cadmium bromide, cerium bromide and thallium bromide, and among these, preferred are potassium bromide and sodium bromide.

When the ion is dissolved out from the light-sensitive material during development processing, the chlorine ion or the bromine ion may be supplied from an emulsion or from those other than the emulsion.

The color developer for use in the present invention has a pH of preferably 10 or more, more preferably from 10.2 to 11.5 and the color developer may contain other compounds known as the developer component.

In order to maintain the pH in the above-described range, various buffer agents may be preferably used. Examples of the buffer agent include carbonate, phosphate, borate, tetraborate, hydroxybenzoate, glycyl salt, N,N-dimethylglycine salt, leucine salt, norleucine salt, guanine salt, 3,4-dihydroxyphenylalanine salt, alanine salt, aminobutyrate, 2-amino-2-methyl-1,3-propanediol salt, valine salt, proline salt, trishydroxyaminomethane salt and lysine salt. In particular, carbonate, phosphate, tetraborate and hydroxybenzoate are advantageous in that they have excellent solubility and buffering ability in a high pH region of 9.0 or more, do not adversely affect the photographic performance (such as fog) when it is added to the color developer and are available cheap, hence, these buffer agents are particularly preferably used.

Specific examples of the buffer agent include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo- 2-hydroxybenzoate (potassium 5-sulfosalicylate), however, the present invention is by no means limited to these compounds.

The addition amount of the buffer agent to the color developer is preferably 0.1 mol/lor more, more preferably from 0.1 to 0.4 mol/l.

In addition, the color developer may contain various chelating agents as a precipitation inhibitor for calcium or magnesium or to improve stability of the color developer. Examples of the chelating agent include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxy-phenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and 1,2-dihydroxybenzene-4,6-disulfonic acid.

These chelating agents may be used in combination of two or more thereof, if desired.

The addition amount of the chelating agent may suffice if it is an amount sufficiently large to sequester metal ions in the color developer. It is, for example, approximately from 0.1 to 10 g/l.

The color developer may contain any development accelerator, if desired.

Examples of the development accelerator include thioether-base compounds described in JP-B-37-16088, JP-B-37-5987, JP-B-38-7826, JP-B-44-12380, JP-B-45-9019 and U.S. Pat. No. 3,813,247, p-phenylenediamine-base compounds described in JP-A-52-49829 and JP-A-50-15554, quaternary ammonium salts described in JP-A-50-137726, JP-B-44-30074, JP-A-56-156826 and JP-A-52-43429, amine-base compounds described in U.S. Pat. Nos. 2,494,903, 3,128,182, 4,230,796 and 3,253,919, JP-B-41-11431 and U.S. Pat. Nos. 2,482,546, 2,596,926 and 3,582,346, polyalkylene oxides described in JP-B-37-16088, JP-B-42-25201, U.S. Pat. No. 3,128,183, JP-B-41-11431, JP-B-42-23883 and U.S. Pat. No. 3,532,501, 1-phenyl-3-pyrazolidones and imidazoles.

In the processing of the present invention, any antifoggant may be added, if desired. Examples of the antifoggant include alkali metal halides such as sodium chloride, potassium bromide and potassium iodide, and organic antifoggants. Representative examples of the organic antifoggant include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The color developer which can be used in the present invention preferably contains a fluorescent brightening agent. The fluorescent brightening agent is preferably a 4,4'-diamino-2,2'-disulfostilbene compound described above.

Further, if desired, various surface active agents such as alkylsulfonic acid, arylsulfonic acid, aliphatic carboxylic acid and aromatic carboxylic acid may be added.

The processing temperature of the color developer for use in the present invention is preferably 30° C. or higher, more preferably from 40 to 55° C., still more preferably from 40 to 50° C. The processing time is preferably 30 seconds or less, more preferably from 5 to 30 seconds, still more preferably from 5 to 20 seconds. The replenishing amount is preferably smaller, however, it is suitable from 20 to 600 ml, preferably from 30 to 120 ml, more preferably from 15 to 60 ml, per $m^2$ of the light-sensitive material.

The desilvering processing solution in the present invention include a bleach-fixing solution, a bleaching solution, and a fixing solution, and preferably a bleach-fixing solution, which are described below.

The bleaching solution or the bleach-fixing solution as the desilvering processing bath (desilvering processing solution) of the present invention contains at least the compound represented by formula (I), and preferably further contains a stilbene fluorescent brightening agent.

In the present invention, any bleaching agent may be used as the bleaching agent for use in the bleaching solution or bleach-fixing solution, however, an organic complex salt of iron(III) (e.g., a complex salt with an aminopolycarboxylic acid such as ethylenediaminetetraacetic acid and diethylenetriaminepentaacetic acid, an aminopolyphosphonic acid, a phosphonocarboxylic acid or an organic phosphonic acid) or an organic acid such as citric acid, tartaric acid and malic acid; a persulfate; and a hydrogen peroxide, of iron(III) are preferred.

Among these, the organic complex salt of iron(III) is particularly preferred in view of rapid processing and environmental pollution prevention. Examples of the aminopolycarboxylic acid, the aminopolyphosphonic, the organic phosphonic acid and the salt thereof useful for forming the organic complex salt of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid. These compounds may be used in the form of a sodium, potassium, lithium or ammonium salt. Among these compounds, iron(III) complex salts with ethylenediaminetetraacetic acid, diethylenetriaminepentaacetic acid, cyclohexanediaminetetraacetic acid, 1,3-diaminopropane-tetraacetic acid and methyliminodiacetic acid are preferred in view of their high bleaching ability. The ferric ion complex salt may be used in the form of a complex salt or may be formed in the solution using a ferric salt such as ferric sulfate, ferric chloride, ferric nitrate, ammonium ferric sulfate or ferric phosphate and a chelating agent such as aminopolycarboxylic acid, aminopolyphosphonic acid or phosphonocarboxylic acid. Further, the chelating agent may be used in excess of the amount necessary for forming ferric ion complex salts. Among iron complexes, an aminopolycarboxylic acid iron complex is preferred and the addition amount thereof is generally from 0.01 to 1.0 mol/l, preferably from 0.05 to 0.50 mol/l, more preferably from 0.10 to 0.50 mol/l, still more preferably from 0.15 to 0.40 mol/l.

The bleaching solution, the bleach-fixing solution and/or the prebath thereof may use various compounds as the bleaching accelerator. For example, compounds having a mercapto group or a disulfide bond described in U.S. Pat. No. 3,893,858, German Patent 1,290,812, JP-A-53-95630 and *Research Disclosure*, No. 17129 (July, 1978), thiourea-base compounds described in JP-B-45-8506, JP-A-52-20832, JP-A-53-32735 and U.S. Pat. No. 3,706,561, and halides such as iodine and bromine ions are preferred in view of their superior bleaching ability.

In addition, the bleaching solution or the bleach-fixing solution for use in the present invention may contain a rehalogenating agent such as a bromide (e.g., potassium bromide, sodium bromide, ammonium bromide), a chloride (e.g., potassium chloride, sodium chloride, ammonium chloride) or an iodide (e.g., ammonium iodide). One or more of an inorganic acid, an organic acid, an alkali metal thereof and an ammonium salt thereof having a pH buffering ability such as borate, sodium metaborate, acetic acid, sodium acetate, sodium carbonate, potassium carbonate, phosphorous acid, phosphoric acid, sodium phosphate, citric acid, sodium citrate and tartaric acid, or an anticorrosive such as ammonium nitrate and guanidine may be added, if desired.

The fixing agent for use in the bleach-fixing solution or the fixing solution may be a known fixing agent, namely, a water-soluble silver halide solubilizer including thioether compounds such as a thiosulfate (e.g., sodium sulfate, ammonium thiosulfate), a thiocyanate (e.g., sodium thiocyanate, ammonium thiocyanate), an ethylenebisthioglycolic acid and a 3,6-dithia-1,8-octanediol; and thioureas. These compounds may be used individually or in combination of two or more thereof. Further a special bleach-fixing solution comprising a combination of a fixing agent with a halide such as a large quantity of potassium iodide described in JP-A-55-155354 may be used. In the present invention, a thiosulfate, particularly ammonium thiosulfate is preferably used. The use amount of the fixing agent is preferably from 0.3 to 2 mol/l, more preferably from 0.5 to 1.0 mol/l.

The bleach-fixing solution or the fixing solution for use in the present invention has a pH of from 3 to 8, more preferably from 4 to 7. If the pH is lower than the above-described range, the desilvering property may be improved but the solution deteriorates and the cyan dye turns to a leuco-dye, whereas if the pH is higher than the above-described range, the desilvering is retarded to readily cause generation of stains.

The bleaching solution for use in the present invention has a pH of 8 or less, preferably from 2 to 7, more preferably from 2 to 6. If the pH is lower than the above-described range, the solution deteriorates and the cyan dye turns to a leuco-dye, whereas if it is higher than the above-described range, stains are readily generated.

In order to adjust the pH, hydrochloric acid, sulfuric acid, nitric acid, bicarbonate, ammonia, caustic potash, caustic soda, sodium carbonate or potassium carbonate may be added, if desired.

The bleach-fixing solution may contain other various fluorescent brightening agents or defoaming agents, a surface active agent or an organic solvent such as polyvinyl pyrrolidone and methanol.

The bleach-fixing solution or the fixing solution preferably contains, as a preservative, a sulfite ion-releasing compound such as a sulfite (e.g., sodium sulfite, potassium sulfite, ammonium sulfite), a bisulfite (e.g., ammonium bisulfite, sodium bisulfite, potassium bisulfite) or a metabisulfite (e.g., potassium metabisulfite, sodium metabisulfite, ammonium metabisulfite). The sulfite ion-releasing compound is added in an amount, in terms of sulfite ions, of preferably from about 0.02 to 1.0 mol/l, more preferably from 0.04 to 0.6 mol/l.

As the preservative, the sulfite is commonly added, and in addition, an ascorbic acid, a carbonyl bisulfite adduct or a carbonyl compound may be added.

Further, a buffer agent, a fluorescent brightening agent, a chelating agent, a defoaming agent or an antimold may be added, if desired.

The processing time in the bleach-fixing of the present invention is from 5 to 120 seconds, preferably from 10 to 60 seconds, more preferably 20 seconds or less. The processing temperature is from 25 to 60° C., preferably from 30 to 50° C. The replenishing amount is from 20 to 250 ml, preferably from 30 to 100 ml, more preferably from 15 to 60 ml, per $m^2$ of the light-sensitive material.

After the desilvering such as fixing or bleach-fixing, the light-sensitive material is generally subjected to water washing and/or stabilization processing.

The amount of washing water in the water washing step may be set over a wide range depending upon the properties (for example, due to materials used such as a coupler) or use of the light-sensitive material, the temperature of washing water, the number of water washing tanks (stage number) and other various conditions. Among these conditions, the relation between the number of water washing tanks and the amount of water in a multi-stage countercurrent system may be determined according to the method described in *Journal of the Society of Motion Picture and Television Engineers*, vol. 64, pp. 248–253 (May, 1955). Usually, in the multi-stage countercurrent system, the stage number is preferably from 3 to 15, more preferably from 3 to 10.

According to the multi-stage countercurrent system, the amount of washing water may be greatly reduced, for example, to 500 ml or less per $m^2$ of the light-sensitive material, however, due to the increase in the residence time of water within the tank, bacteria proliferate to cause a problem such that the floating produced attaches to the light-sensitive material. As a countermeasure to the problem, a method of reducing calcium or magnesium described in JP-A-62-288838 may be very effectively used. Also, isothiazolone compounds or thiabendazoles described in JP-A-57-8542, chlorine-base germicides such as chlorinated sodium isocyanurate described in JP-A-61-120145, benzotriazoles or copper ions described in JP-A-61-267761 or germicides described in Hiroshi Horiguchi, *Bokin, Bobai no Kagaku*, Sankyo Shuppan (1986), *Biseibutsu no Mekkin, Sakkin, Bobai-Giiutsu*compiled by Eisei Gijutsu Kai, issued by Kogyo Gijutsu Kai (1982), and *Bokin-Bobai Zai Jiten* compiled by Nippon Bokin Bobai Gakkai (1986) may be used.

The washing water may use a surface active agent as a dewatering agent or a chelating agent represented by EDTA as a hard water-softening agent.

The light-sensitive material may be treated with a stabilization solution following the above-described water washing step or directly without passing through the water washing step. The stabilization solution contains a compound having an image stabilizing function and examples of the compound include an aldehyde compound represented by formalin, a buffer agent so as to adjust the layer pH suitable for the dye stabilization, and an ammonium compound. Further, in order to prevent proliferation of bacteria in the solution or to impart an antimold property to the light-sensitive material after the processing, various germicides or antimolds described above may be used.

Further, the stabilization solution may contain a surface active agent, a fluorescent brightening agent or a hardening agent. In the processing of the light-sensitive material of the present invention, when the stabilization is conducted directly without passing through the water washing step, all of known methods described in JP-A-57-8543, JP-A-58-14834 and JP-A-60-220345 may be used.

In another preferred embodiment, a chelating agent such as 1-hydroxyethylidene-1,1-diphosphonic acid and ethylenediaminetetramethylenephosphonic acid, magnesium or a bismuth compound may be used.

A so-called rinsing solution may also be used similarly as the water washing solution or stabilization solution to be used after the desilvering.

In the water washing or stabilization step, the pH is preferably from 4 to 10, more preferably from 5 to 8. The temperature may be set variously according to the use or properties of the light-sensitive material but it is generally from 20 to 50° C., preferably from 25 to 45° C. The time may be freely established but it is preferably shorter in view of the reduction in the processing time. The processing time in the water washing or stabilization step is preferably from 10 to 60 seconds, more preferably from 15 to 45 seconds. The replenishing amount is preferably smaller in view of the running cost, the reduction in discharge or the handleability.

More specifically, the preferred replenishing amount is from 0.5 to 50 times, preferably from 3 to 40 times, the amount carried over from the previous bath per the unit area of the light-sensitive material. It is 500 ml or less, preferably 300 ml or less, per $m^2$ of the light-sensitive material. The replenishment may be made either continuously or intermittently.

The solution used in the water washing and/or stabilization step may further be used in the previous step. For example, the amount of discharge may be reduced by flowing the overflow of washing water reduced according to the multi-stage countercurrent system into the bleach-fixing bath as the prebath of the water washing bath and replenishing the bleach-fixing bath with a concentrated solution.

The stirring in each processing tank of the present invention may be made using known methods such as a solution-spraying method, a mechanical stirring method or a method using ultrasonic waves. A method capable of direct influence on the surface of the light-sensitive material is particularly preferred and, for example, a method using the pressure upon passing between a pair of rollers may be used.

The drying step which can be used in the present invention is described. In order to finish an image according to the ultra-rapid processing of the present invention, the drying time is preferably from 10 to 40 seconds.

With respect to the technique for reducing the drying time, as the technique applied to the light-sensitive material side, the amount of hydrophilic binder may be reduced to reduce the amount of water carried over into the film, thereby achieving reduction in the drying time. Also, in view of reduction in the carry-over amount of water, the light-sensitive material immediately after coming out from the water washing bath may be treated with a squeeze roller or cloth which absorbs water to thereby hasten the drying. As the technique applied to the drier side, as a matter of course, the drying may be hastened by elevating the temperature or modifying the shape of spraying nozzles to intensify the drying air. Further, as described in JP-A-3-157650, the drying may be accelerated by controlling the blowing angle of drying air to the light-sensitive material or according to a method of removing exhaust air.

The light-sensitive material which can be used in the present invention is described.

The silver halide for use in the present invention of the present invention includes silver chloride, silver bromide, silver (iodo)chlorobromide and silver iodobromide, however, for the purpose of rapid processing, silver chlorobromide or silver chloride emulsion containing substantially no silver iodide and having a silver chloride content of 98 mol % or more is preferably used. The term "contains substantially no silver iodide" as used herein means that the silver iodide content is preferably 0.1 mol % or less, more preferably 0.01 mol % or less, and most preferably, the silver iodide is not contained at all.

The hydrophilic colloid for use in the light-sensitive material of the present invention may be any of those commonly used in the field of the present invention. More specifically, gelatin, polyvinyl alcohol, polyacrylamide or carboxymethyl cellulose may be used and among these, gelatin is preferred.

In the light-sensitive material of the present invention, it is preferred, for the purpose of improving sharpness of an image, to incorporate into a hydrophilic colloid layer a dye (particularly, an oxonol-base dye) capable of discoloration upon processing to give an optical reflection density of the light-sensitive material at 680 nm of 0.70 or more or to incorporate into a water-resistant resin layer of the support titanium oxide of which surface is treated with di-, tri- or tetrahydric alcohol (e.g., trimethylolethane) at a proportion of 12 wt % or more (more preferably, 14 wt % or more).

The light-sensitive material of the present invention preferably contains an antimold as described in JP-A-63-271247 so as to prevent various molds or bacteria which proliferate in a hydrophilic colloid layer to deteriorate the image.

The support for use in the light-sensitive material of the present invention may be a white polyester-base support for display or a support having provided on the side having a silver halide emulsion layer a layer containing a white pigment. Further, in order to improve sharpness, an antihalation layer is preferably provided on the side of the surface where a silver halide emulsion layer is coated or on the back surface of the support. The transmission density of the support is preferably set to fall between 0.35 and 0.8 so that the display can be viewed with either reflection light or transmitted light.

The light-sensitive material of the present invention may be exposed to visible light or to infrared light. The exposure method may be either a low illumination exposure or a high illumination short time exposure. In the latter case, a laser scanning exposure method where the exposure time is $10^{-4}$ seconds or shorter per one picture element, is preferably used.

The exposed light-sensitive material may be subjected to color development but for the purpose of rapid processing, it is preferably subjected to bleach-fixing after the color development. In particular, when the above-described high silver chloride emulsion is used, the pH of the bleach-fixing solution is preferably about 7 or less, more preferably about 6.5 or less, so as to accelerate desilverization.

With respect to the silver halide emulsion, other materials (e.g., additives) and the photographic constituent layers (e.g., layer arrangement) to be applied to the light-sensitive material of the present invention as well as the processing method and the additives for use in the processing of the light-sensitive material of the present invention, those described in the following patent publications, particularly in EP 0355660A2, are preferably used.

| Photographic Constituent Element | JP-A-62-215272 | JP-A-2-33144 | EP 0355660A2 |
|---|---|---|---|
| Silver halide emulsion | p. 10, right upper col., line 6 to p. 12, left lower col., line 5 and p. 12, right lower col., line 4 from the bottom to p. 13, left upper col., line 17 | p. 28, right upper col., line 16 to p. 29, right lower col., line 11 and p. 30, lines 2 to 5 | p. 45, line 53 to p. 47, line 3 and p. 47, lines 20 to 22 |
| Silver halide solvent | p. 12, left lower col., lines 6 to 14 and p. 13, left upper col., line 3 from the bottom to p. 18, left lower col., last line | — | — |
| Chemical sensitizer | p. 12, left lower col., line 3 from the bottom to right lower col., line 5 from the bottom, p. 18, right lower col., line 1 to p. 22, right upper col., line 9 from the bottom | p. 29, right lower col., line 12 to last line | p. 47, lines 4 to 9 |
| Spectral sensitizer (spectral sensitization) | p. 22, right upper col., line 8 from the bottom to p. 38, last line | p. 30, left upper col., lines 1 to 13 | p. 47, lines 10 to 15 |
| Emulsion stabilizer | p. 39, left upper col., line 1 to p. 72, right upper col., last line | p. 30, left upper col., line 14 to right upper col., line 1 | p. 47, lines 16 to 19 |
| Development accelerator | p. 72, left lower col., line 1 to p. 91, right upper col., line 3 | — | — |
| Color coupler (cyan, magenta, yellow couplers) | p. 91, right upper col., line 4 to p. 121, left upper col., line 6 | p. 3, right upper col., line 14 to p. 18, left upper col., last line and p. 30, right upper col., line 6 to p. 35, right lower col., line 11 | p. 4, lines 15 to 27, p. 5, line 30 to p. 28, last line, p 45, lines 29–31 and p. 47, line 23 to p. 63, line 50 |
| Coloration increasing agent | p. 121, left upper col., line 7 to p. 125, right upper col., line 1 | — | — |
| Ultraviolet absorbent | p. 125, right upper col., line 2 to p. 127, left lower col., last line | p. 37, right lower col., line 14 to p. 38, left upper col., line 11 | p. 65, lines 22 to 31 |
| Discoloration inhibitor (image stabilizer) | p. 127, right lower col., line 1 to p. 137, left lower col., line 8 | p. 36, right upper col., line 12 to p. 37, left upper col., line 19 | p. 4, line 30 to p. 5, line 23, p. 29, line 1 to p. 45, line 25, p. 45, lines 33 to 40, p. 65, lines 2 to 21 |
| High boiling point and/or low boiling point organic solvent | p. 137, left lower col., line 9 to p. 144, right upper col., last line | p. 35, right lower col., line 14 to p. 36, left upper col., line 4 from the bottom | p. 64, lines 1 to 51 |
| Dispersion method of photographic additives | p. 144, left lower col., line 1 to p. 146, right upper col., line 7 | p. 27, right lower col., line 10 to p. 28, left upper col., last line and p. 35, right lower col., line 12 to p. 36, right upper col., line 7 | p. 63, line 51 to p. 64, line 56 |
| Hardening agent | p. 146, right upper col., line 8 to p. 155, left lower col., line 4 | — | — |
| Developing agent precursor | p. 155, left lower col., line 5 to p. 155, right lower col., 1 line 2 | — | — |
| Development inhibitor-releasing compound | p. 155, right lower col., lines 3 to 9 | — | — |

-continued

| Photographic Constituent Element | JP-A-62-215272 | JP-A-2-33144 | EP 0355660A2 |
|---|---|---|---|
| Support | p. 155, right lower col., line 19 to p. 156, left upper col., line 14 | p. 38, right upper col., line 18 to p. 39, left upper col., line 3 | p. 66, line 29 to p. 67, line 13 |
| Photographic material layer structure | p. 156, left upper col., line 15 to p. 156, right lower col., line 14 | p. 28, right upper col., lines 1 to 15 | p. 45, lines 41 to 52 |
| Dyestuff | p. 156, right lower col., line 15 to p. 184, right lower col., last line | p. 38, left upper col., line 12 to right upper col., line 7 | p. 66, lines 18 to 22 |
| Color mixing inhibitor | p. 185, left upper col., line 1 to p. 188, right lower col., line 3 | p. 36, right upper col., lines 8 to 11 | p. 64, line 57 to p. 65, line 1 |
| Gradation controlling agent | p. 188, right lower col., lines 4 to 8 | — | — |
| Stain inhibitor | p. 188, right lower col., line 9 to p. 193, right lower col., line 10 | p. 37, left upper col., last line to right lower col., line 13 | p. 65, line 32 to p. 66, line 17 |
| Surface active agent | p. 201, left lower col., line 1 to p. 210, right upper col., last line | p. 18, right upper col., line 1 to p. 24, right lower col., last line and p. 27, left lower col., line 10 from the bottom to right lower col., line 9 | — |
| Fluorine-containing compound (antistatic agent, coating aid, lubricant, adhesion-preventing agent) | p. 210, left lower col., line 1 to p. 222, left lower col., line 5 | p. 25, left upper col., line 1 to p. 27, right lower col., line 9 | — |
| Binder (hydrophilic colloid) | p. 222, left lower col., line 6 to p. 225, left upper col., last line | p. 38, right upper col., lines 8 to 18 | p. 66, lines 23 to 28 |
| Thickener | p. 225, right upper col., line 1 to p. 227, right upper col., line 2 | — | — |
| Antistatic agent | p. 227, right upper col., line 3 to p. 230, left upper col., line 1 | — | — |
| Polymer latex | p. 230, left upper col., line 2 to p. 239, last line | — | — |
| Matting agent | p. 240, left upper col., line 1 to p. 240, right upper col., last line | — | — |
| Photographic processing (processing steps and additives) | p. 3, right upper col., line 7 to p. 10, right upper col., line 5 | p. 39, left upper col., line 4 to p. 42, left upper col., last line | p. 67, line 14 to p. 69, line 28 |

Note) The disclosure of JP-A-62-215272 referred to herein includes the amendments in the written revision filed on March 16, 1987 which is attached to the end of the publication.
Among color couplers, as the yellow coupler, so-called shortwave yellow couplers described in JP-A-63-231451, JP-A-63-123047, JP-A-63-241547, JP-A-1-173499, JP-A-1-213648 and JP-A-1-250944 are also preferably used.

As the cyan coupler, in addition to diphenylimidazole-base cyan couplers described in JP-A-2-33144, 3-hydroxypyridine-base cyan couplers described in EP 0333185A2 (preferably, among those described as specific examples therein, Coupler (42) which is a two-equivalent coupler resulting from giving a chlorine releasing group to a four-equivalent coupler, and Couplers (6) and (9)) and cyclic active methylene-base cyan couplers described in JP-A-64-32260 (preferably, among those described as specific examples, Couplers 3, 8 and 34) may also be preferably used.

The cyan, magenta or yellow coupler is preferably impregnated into a loadable latex polymer (described, for example, in U.S. Pat. No. 4,203,716) in the presence (or absence) of a high boiling point organic solvent described in the table above, dissolved together with a water-insoluble and organic solvent-soluble polymer and emulsion-dispersed in an aqueous solution of hydrophilic colloid.

The water-insoluble and organic-solvent soluble polymer which can be preferably used includes homopolymers and copolymers described in U.S. Pat. No. 4,857,449, cols. 7–15 and International Patent Unexamined Publication WO88/00723, pp. 12–30, more preferred are methacrylate- or acrylamide-base polymers, and acrylamide-base polymers are particularly preferably used in view of the dye image stability.

The light-sensitive material of the present invention preferably uses a dye image preservability-improving compound as described in European Patent EP 0277589A2 in combination with couplers. In particular, a pyrazoloazole coupler, a pyrrolotriazole coupler or an acylacetamide yellow coupler is preferably used in combination.

In other words, it is preferred to use individually or simultaneously a compound capable of chemical bonding to an aromatic amine developing agent remaining after color development to produce a chemically inert and substantially colorless compound and/or a compound capable of chemical bonding to an oxidation product of an aromatic amine color developing agent remaining after color development to produce a chemically inert and substantially colorless compound, for preventing generation of stains or other side effects resulting from formation of a colored dye upon reaction of a coupler with a color developing agent or an oxidation product thereof remaining in the layer during storage after the processing.

With respect to the cyan coupler, in addition to the phenolic couplers and naphthol couplers described in publications in the table above, diphenylimidazole-base cyan couplers described in JP-A-2-33144, 3-hydroxypyridine-base cyan couplers described in EP 0333185A2, cyclic active methylene-base cyan couplers described in JP-A-64-32260, pyrrolopyrazole cyan couplers described in EP 0456226A1, pyrroloimidazole cyan couplers described in EP 0484909 and pyrrolotriazole cyan couplers described in EP 0488248 and EP 0491197A1 are preferably used. Among these, pyrrolotriazole cyan couplers are particularly preferred.

As the magenta coupler for use in the present invention, 5-pyrazolone-base magenta couplers as described in publications in the table above may be used. As the 5-pyrazolone-base magenta coupler, arylthio-releasing 5-pyrazolone-base magenta couplers described in International Patent Unexamined Publications WO92/18901, WO92/18902 and WO92/18903 are preferred in view of image preservability or of less change in the image quality due to the processing.

Other than those described above, known pyrazoloazole couplers may be used as the magenta coupler in the present invention and among these, preferred in view of color hue, image stability and color forming property are pyrazolotriazole couplers having a secondary or tertiary alkyl group bonded directly to the 2-, 3- or 6-position of the pyrazolotriazole ring described in JP-A-61-65245, pyrazoloazole couplers containing a sulfoamide group in the molecule described in JP-A-61-65246, pyrazoloazole couplers having an alkoxyphenylsulfonamide ballast group described in JP-A-61-14254 and pyrazoloazole couplers having an alkoxy group or an aryloxy group at the 6-position described in European Patents 226849A and 294785A.

As the yellow coupler, known acylacetanilde couplers are preferably used and among these, preferred are pivaloylacetanilde couplers having a halogen atom or an alkoxy group at the ortho position of the anilide ring, acylacetanilde couplers with the acyl group being a 1-position-substituted cycloalkanecarbonyl group described in EP 0447969A1, JP-A-5-107701 and JP-A-5-113642 and malondianilide couplers described in EP 0482552A and EP 0524540A.

With respect to the processing method of the color light-sensitive material of the present invention, in addition to the methods described in the table above, the processing materials and processing methods described in JP-A-2-207250, page 26, right lower column, line 1 to page 34, right upper column, line 9, and in JP-A-4-97355, page 5, left upper column, line 17 to page 18, right lower column, line 20 are preferably used.

One embodiment of the method of the present invention is described below by referring to the drawing attached hereto, however, the present invention is by no means limited to this embodiment.

FIGURE is a view showing a processing machine of a silver salt photographic color paper, to which the present invention is applied. In the processing machine, a web-like color paper exposed based on a positive original is developed, bleach-fixed, water washed and dried to form an image on the color paper. The color paper (hereinafter referred to as a light-sensitive material) processed in the processing machine is a silver halide color photographic light-sensitive material 20 comprising a support having thereon at least one silver halide emulsion layer having a silver chloride content of 98 mol % or more and color developed with a color developer containing an aromatic primary amine color developing agent.

The processing machine body 10 comprises a development tank 12, a bleach-fixing tank 14, water washing tanks 16*a* to 16*e* and a drying zone 7 and the exposed light-sensitive material 20 is taken out from the body 10 after development, bleach-fixing, water washing and drying.

The light-sensitive material 20 is transported while being interposed between a pair of transportation rollers 24 with the emulsion surface facing downward and it is dipped in a processing solution for a predetermined time and color developed.

The light-sensitive material travels in the solution between water washing tanks 16*a* to 16*e* through blades 28 provided on the wall of respective tanks. For the blade 28 in solution, various plastic materials may be used but in view of resiliency and durability necessary for sealing the solution, polyurethane rubber is particularly preferred. In each tank, blocks 29 are disposed everywhere so as to prevent clogging of the light-sensitive material 20. Five water washing tanks 16*a* to 16*e* are disposed and respective tanks are piped in a cascade manner such that the cleanliness of washing water is lowered in sequence from the final stage tank 16*e* toward the first stage tank 16*a*. In the water washing tank, a reverse osmosis membrane (RO membrane) equipment 26 is provided. The water in the fourth water washing tank 16*d* is sent under pressure to the reverse osmosis membrane equipment 26 by means of a pump 30, the clean transmission water passed through the reverse osmosis membrane equipment 26 is fed to the fifth water washing tank 16*e* and the concentrated water failed in passing through the reverse osmosis membrane equipment 26 is fed to the fourth water washing tank 16*d*. After the water washing, the light-sensitive material 20 is transported to the drying zone 7. In the drying zone 7, a hot blast of from 80 to 100° C. is directly sprayed to the layer surface of the light-sensitive material from blowing-off outlets 33 at a wind velocity of from 5 to 20 m/sec to dry the light-sensitive material. On the wall of and blocks 29 in each tank, spraying nozzles 32 (circles each having a diameter of 2 mm) are provided to agitate the circulating solution by means of a pump 31 and particularly in the development tank 12, the blowing amount is variably set at a flow rate of from 0.5 to 12 l/min by controlling the pump.

The present invention is described below in greater detail by referring to the examples, but the present invention should not be construed as being limited thereto.

EXAMPLE 1

Sample 100 having the following layer structure was prepared by subjecting the surface of a paper support of which both surfaces were laminated with polyethylene to corona discharge treatment, then providing thereon a gelatin undercoat layer containing sodium dodecylbenzenesulfonate and further coating thereon various photographic constituent layers.

The coating solutions were prepared as follows.

Preparation of Coating Solution for Third Layer

Into 10.0 g of Dye Image Stabilizer (Cpd-7), 80.0 g of Dye Image Stabilizer (Cpd-8), 500 g of Solvent (Solv-3) and 360 ml of ethyl acetate, 120.0 g of Magenta Coupler (E×M) and 10.0 g of Dye Image Stabilizer (Cpd-6) were dissolved and the resulting solution was emulsion-dispersed in 2,000 g of a 16% aqueous gelatin solution containing 60 ml of a 10% sodium dodecylbenzenesulfonate and 10 g of citric acid to prepare Emulsified Dispersion A. Separately, Silver Chlorobromide Emulsion B (cubic; a ⅓ mixture (by mol in terms of silver) of Large Size Emulsion B having an average grain size of 0.55 μm and Small Size Emulsion B having an average grain size of 0.39 μm; coefficients of variation in the grain size distribution being 0.10 and 0.08, respectively; each size Emulsion comprising a silver halide grain where 0.8 mol % of silver bromide was localized on a part of the grain surface and the remaining was silver chloride) was prepared. To the Emulsion, Green-Sensitive Sensitizing Dyes D, E and F shown below were added in an amount of $3.0\times10^{-4}$ mol/mol-Ag, $4.0\times10^{-5}$ mol/mol-Ag and $2.0\times10^{-4}$ mol/mol-Ag, respectively, for Large Size Emulsion B and in an amount of $3.6\times10^{-4}$ mol/mol-Ag, $7.0\times10^{-5}$ mol/mol-Ag and $2.8\times10^{-4}$ mol/mol-Ag, respectively, for Small Size Emulsion B. The emulsion was subjected to chemical ripening by adding a sulfur sensitizer and a gold sensitizer. Emulsified Dispersion A prepared above and Silver Chlorobromide Emulsion B were mixed and dissolved to prepare the coating solution for the third layer having the composition described later.

The coating solutions for the first to seventh layers were prepared in the same manner as the coating solution for the third layer. In each layer, 1-oxy-3,5-dichloro-s-triazine sodium salt was used as a gelatin hardening agent.

Further, to each layer, Cpd-12, Cpd-13, Cpd-14 and Cpd-15 were added to give the total amount of 15.0 mg/m$^2$, 60.0 mg/m$^2$, 50 mg/m$^2$ and 10.0 mg/m$^2$, respectively.

In the silver chlorobromide emulsion of each light-sensitive emulsion layer, the following spectral sensitizing dyes were used.

Blue-Sensitive Emulsion Layer

Sensitizing Dye A

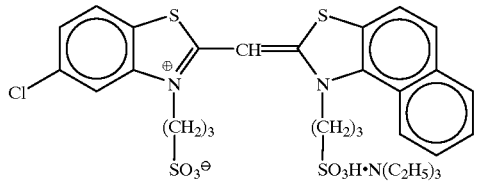

Sensitizing Dye B

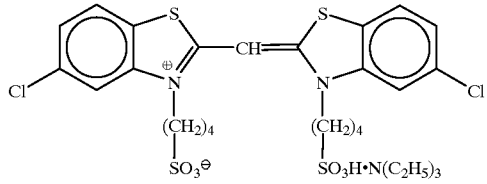

Sensitizing Dye C

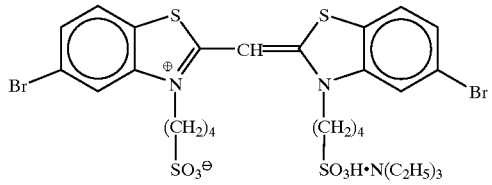

(Each sensitizing dye was added in an amount of $1.4\times10^{-4}$ mol for the large size emulsion and in an amount of $1.7\times10^{-4}$ mol for the small size emulsion, per mol of silver halide.)

Green-Sensitive Emulsion Layer

Sensitizing Dye D

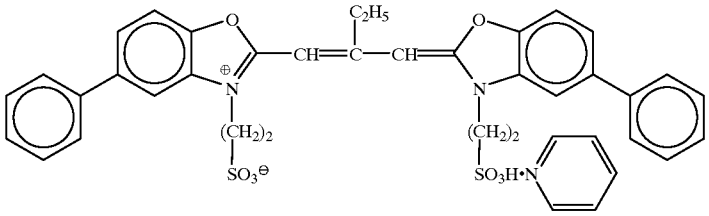

Sensitizing Dye E

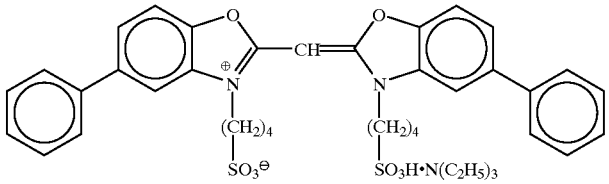

Sensitizing Dye F

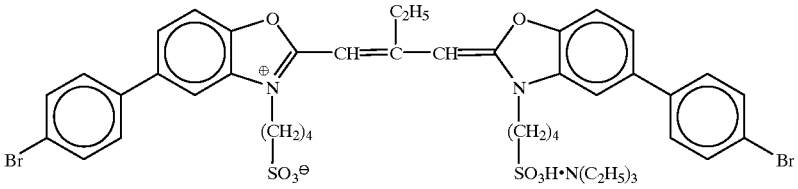

(Sensitizing Dye D was added in an amount of $3.0\times10^{-4}$ mol for the large size emulsion and in an amount of $3.6\times10^{-4}$ mol for the small size emulsion, per mol of silver halide; Sensitizing Dye E was added in an amount of $4.0\times10^{-5}$ mol for the large size emulsion and in an amount of $7.0\times10^{-5}$ mol for the small size emulsion, per mol of silver halide; and Sensitizing Dye F was added in an amount of $2.0\times10^{-4}$ mol for the large size emulsion and in an amount of $2.8\times10^{-4}$ mol for the small size emulsion, per mol of silver halide.)

Red-Sensitive Emulsion Layer

Sensitizing Dye G

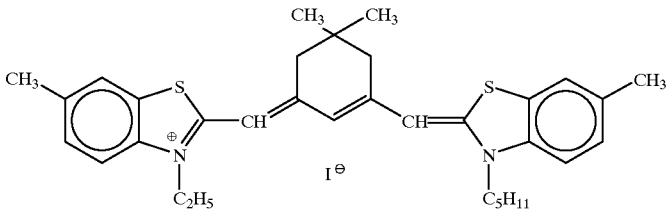

Sensitizing Dye H

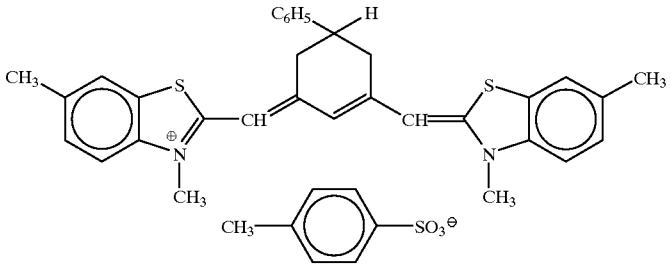

(Each senisitizing dye was added in an amount of $5.0\times10^{-5}$ mol for the large size emulsion and in an amount of $8.0\times10^{-5}$ mol for the small size emulsion, per mol of silver halide.)

Further, the following compound was added in an amount of $2.6\times10^{-3}$ mol per mol of silver halide.

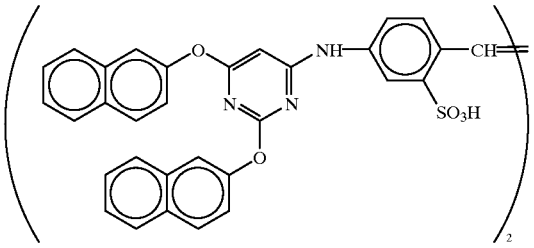

Furthermore, to the blue-sensitive emulsion layer, the green-sensitive emulsion layer and the red-sensitive emulsion layer, 1-(5-methylureidophenyl)-5-mercaptotetrazole was added in an amount of $3.3\times10^{-4}$ mol, $1.0\times10^{-3}$ mol and $5.9\times10^{-4}$ mol, respectively, per mol of silver halide.

Still further, to the second, fourth, sixth and seventh layers, the compound was added to give a coverage of 0.2 mg/m$^2$, 0.2 mg/m$^2$, 0.6 mg/m$^2$ and 0.1 mg/m$^2$, respectively.

To the blue-sensitive emulsion layer and the green-sensitive emulsion layer, 4-hydroxy-6-methyl-1,3,3a,7-tetrazaindene was added in an amount of $1\times10^{-4}$ mol and $2\times10^{-4}$ mol, respectively, per mol of silver halide.

For the purpose of preventing irradiation, the following dyes (in the parentheses, the coating amounts are shown) were added to the emulsion layers.

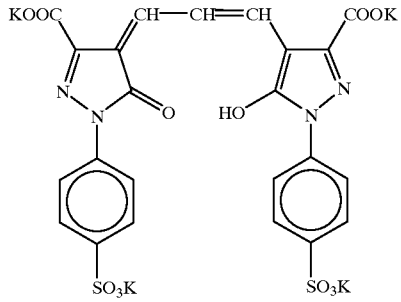

(10 mg/m$^2$)

and

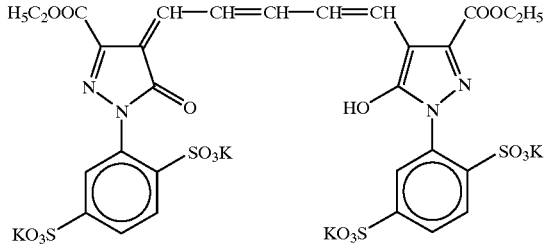

(40 mg/m$^2$)

(Layer Structure)

The composition of each layer is shown below. The numerals show the coating amount (g/m$^2$). With respect to the silver halide emulsion, the numerals show the coating amount calculated in terms of silver.

Support

Polyethylene laminated paper (containing a white pigment ($TiO_2$) and a bluish dye (ultramarine) in the polyethylene on the first layer side).

| First Layer (Blue-sensitive Emulsion Layer) | |
|---|---|
| Silver Chlorobromide Emulsion B prepared above | 0.24 |
| Gelatin | 1.29 |
| Yellow Coupler (ExY) | 0.61 |
| Dye Image Stabilizer (Cpd-1) | 0.08 |
| Dye Image Stabilizer (Cpd-2) | 0.04 |
| Dye Image Stabilizer (Cpd-3) | 0.08 |
| Solvent (Solv-1) | 0.22 |
| **Second Layer (Color Mixing Preventing Layer)** | |
| Gelatin | 1.00 |
| Color Mixing Inhibitor (Cpd-4) | 0.11 |
| Solvent (Solv-1) | 0.07 |
| Solvent (Solv-2) | 0.25 |
| Solvent (Solv-3) | 0.19 |
| Solvent (Solv-7) | 0.07 |
| **Third Layer (Green-sensitive Emulsion Layer)** | |
| Silver chlorobromide emulsion (cubic; a 1:3 (by mol as silver) mixture of Large-size Emulsion B having an average grain size of 0.55 μm and Small-size Emulsion B having an average grain size of 0.39 μm; coefficients of variation in the grain size distribution being 0.10 and 0.08, respectively; each size emulsion containing 0.8 mol % of AgBr localized on a part of the surface of a grain comprising silver chloride as a substrate) | 0.11 |
| Gelatin | 1.21 |
| Magenta Coupler (ExM) | 0.12 |
| Dye Image Stabilizer (Cpd-6) | 0.01 |
| Dye Image Stabilizer (Cpd-7) | 0.08 |
| Dye Image Stabilizer (Cpd-8) | 0.03 |
| Solvent (Solv-7) | 0.50 |
| **Fourth Layer (Color Mixing Preventing Layer)** | |
| Gelatin | 0.71 |

-continued

| | |
|---|---|
| Color Mixing Inhibitor (Cpd-4) | 0.08 |
| Solvent (Solv-1) | 0.05 |
| Solvent (Solv-2) | 0.18 |
| Solvent (Solv-3) | 0.14 |
| Solvent (Solv-7) | 0.06 |
| **Fifth Layer (Red-sensitive Emulsion Layer)** | |
| Silver chlorobromide emulsion (cubic; a 1:4 (by mol as Ag) mixture of Large-size Emulsion C having an average grain size of 0.50 μm and Small-size Emulsin C having an average grain size of 0.41 μm; coefficients of variation in the grain size distribution being 0.09 and 0.11, respectively; each size emulsion containing 0.8 mol % of AgBr localized on a part of the surface of a grain comprising silver chloride as a substrate) | 0.18 |
| Gelatin | 1.03 |
| Cyan Coupler (ExC) | 0.28 |
| Ultraviolet Absorbent (UV-3) | 0.19 |
| Dye Image Stabilizer (Cpd-1) | 0.24 |
| Dye Image Stabilizer (Cpd-6) | 0.01 |
| Dye Image Stabilizer (Cpd-8) | 0.01 |
| Dye Image Stabilizer (Cpd-9) | 0.04 |
| Dye Image Stabilizer (Cpd-10) | 0.01 |
| Solvent (Solv-1) | 0.01 |
| Solvent (Solv-6) | 0.21 |
| **Sixth Layer (Ultraviolet Absorbing Layer)** | |
| Gelatin | 0.56 |
| Ultraviolet Absorbent (UV-2) | 0.39 |
| Dye Image Stabilizer (Cpd-7) | 0.05 |
| Solvent (Solv-8) | 0.05 |
| **Seventh Layer (Protective Layer)** | |
| Gelatin | 1.00 |
| Acryl-modified copolymer of polyvinyl alcohol (modification degree: 17%) | 0.04 |
| Liquid paraffin | 0.02 |
| Surface Active Agent (Cpd-11) | 0.01 |

The compounds used in this Example are shown below.

Yellow Coupler (ExY)

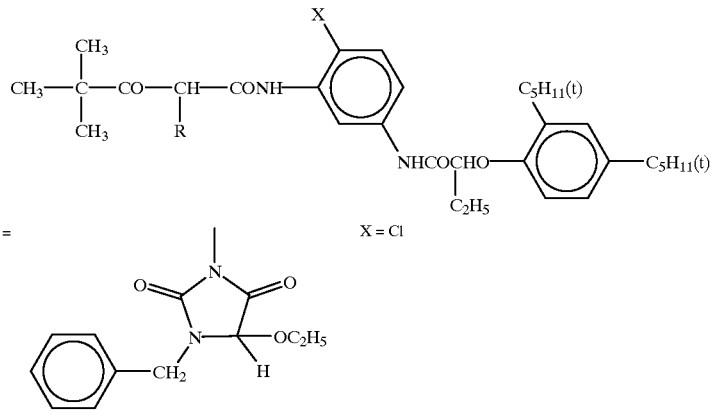

-continued
Magenta Coupler (ExM)
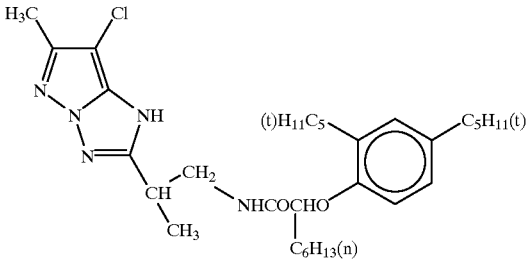
Cyan Coupler (ExC)
A 25/75 mixture (by mol) of:
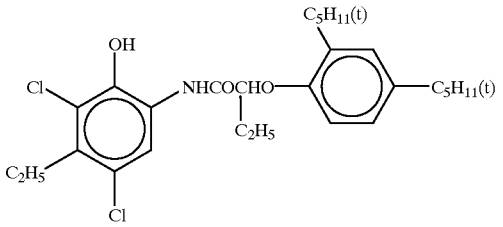
and
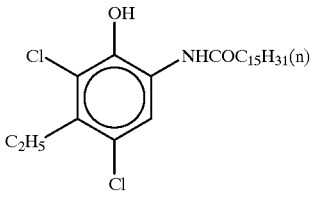
Dye Image Stabilizer (Cpd-1)
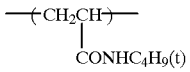
number average molecular weight: 60,000
Dye Image Stabilizer (Cpd-2)
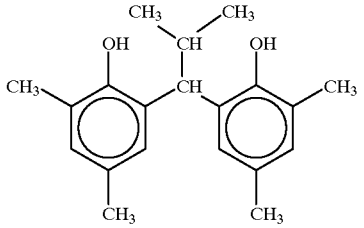
Dye Image Stabilizer (Cpd-3)
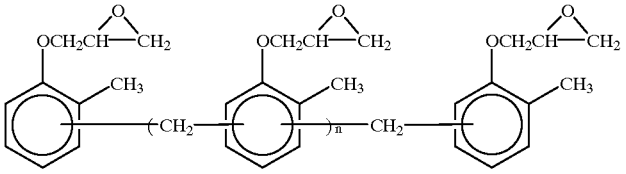
*n* = 7 to 8 (average)
Color Mixing Inhibitor (Cpd-4)
A 1/1/1 mixture (by weight) of (1), (2) and (3):
(1)
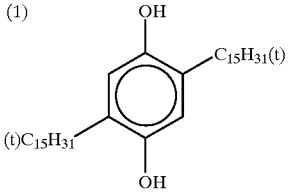
(2)
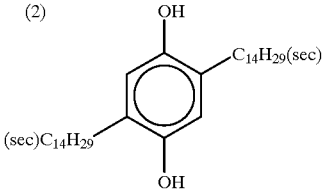
(3)
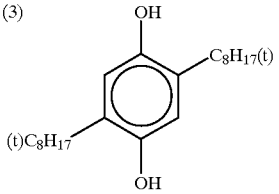
Dye Image Stabilizer (Cpd-5)
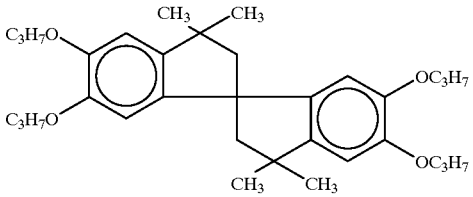
Dye Image Stabilizer (Cpd-6)
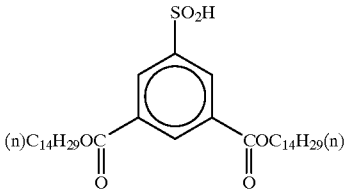

-continued
Dye Image Stabilizer (Cpd-7)
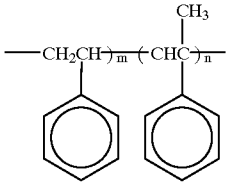
number average molecular weight: 600
*m*/*n* = 9/1
Dye Image Stabilizer (Cpd-8)
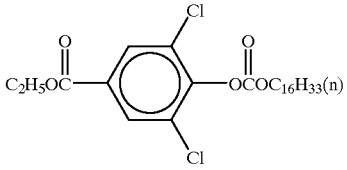
Dye Image Stabilizer (Cpd-9)
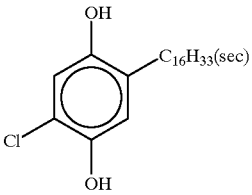
Dye Image Stabilizer (Cpd-10)
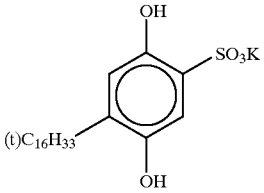
Surface Active Agent (Cpd-11)
A 7/3 mixture (by weight) of:
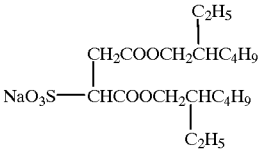
and
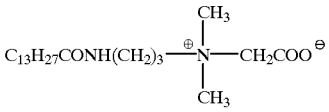
Antiseptic (Cpd-12)
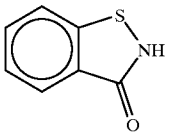
Antiseptic (Cpd-13)
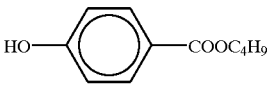
Antiseptic (Cpd-14)
A 1/1/1/1 mixture (by weight) of a, b, c and d:
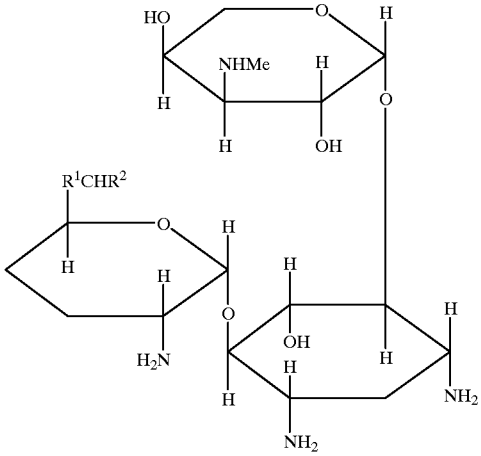
| | $R^1$ | $R^2$ |
|---|---|---|
| a | —Me | —NHMe |
| b | —Me | —$NH_2$ |
| c | —H | —$NH_2$ |
| d | —H | —NHMe |
Antiseptic (Cpd-15)
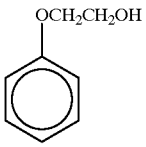

-continued
Ultraviolet Absorbent (UV-2)
A 1/2/2/3/1 mixture (by weight) of (1), (2), (3), (4) and (5):
(1)
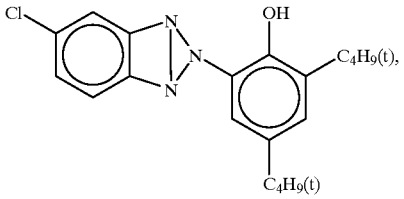
(2)
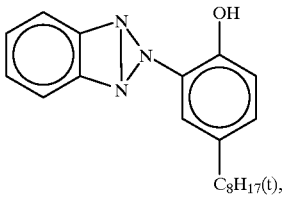
(3)
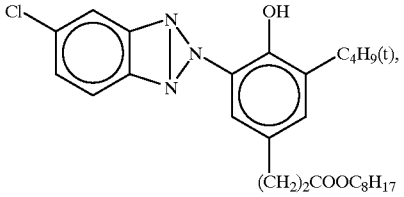
(4)
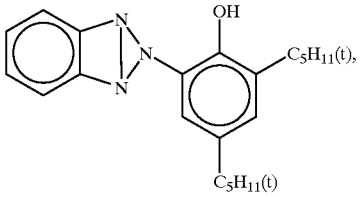
(5)
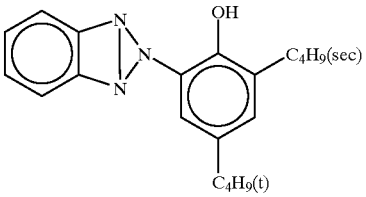
Ultraviolet Absorbent (UV-3)
A 1/3/2/1 mixture (by weight) of (1), (2), (3) and (4):
(1)
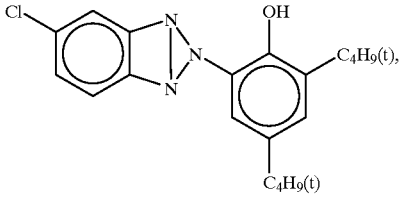
(2)
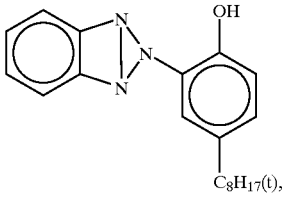
(3)
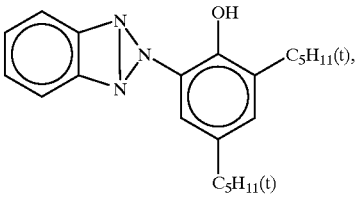
(4)
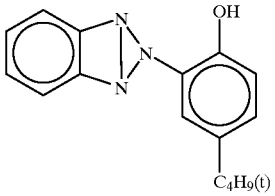
Solvent (Solv-1)
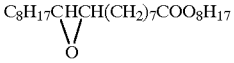
Solvent (Solv-2)
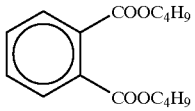
Solvent (Solv-3)
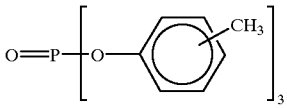
Solvent (Solv-6)
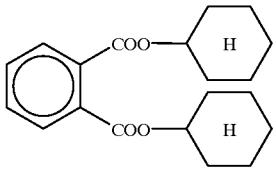

-continued

Solvent (Solv-7)

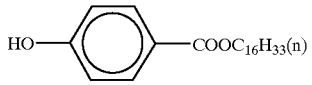

Solvent (Solv-8)

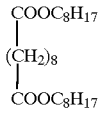

Sample 100 was then subjected to gradation exposure through a three color resolution filter for sensitometry or exposure through a resolution chart, using a sensitometry (Model FW, manufactured by Fuji Photo Film Co., Ltd.; color temperature of the light source: 3,200° K.). At this time, the exposure was conducted for an exposure time of 0.1 second to give an exposure amount of 250 CMS.

After the completion of exposure, the sample was processed through the following processing steps with the following processing formulation using a processing apparatus having a constitution shown in FIGURE which is an embodiment of the present invention. The processing was continued until the replenishing amount of the color developer reached the tank volume.

| Processing Step | Temperature (° C.) | Time (sec.) | Replenisher* (ml) | Tank Volume (l) |
|---|---|---|---|---|
| Color development | 45 | 22 | 35 | 6.0 |
| Bleach-fixing | 40 | 15 | 35 | 4.0 |
| Rinsing (1) | 40 | 3 | — | 1.7 |
| Rinsing (2) | 40 | 3 | — | 1.2 |
| Rinsing (3) | 40 | 3 | — | 1.2 |
| Rinsing (4) | 40 | 3 | — | 1.2 |
| Rinsing (5) | 40 | 6 | 70 | 1.7 |
| Drying | 100 | 12 | (wind velocity: 15 m/sec) | |

*: Replenishing amount was shown by the amount per 1 $m^2$ of the light-sensitive material.

In each tank, a jetting water stream was sprayed at right angles onto the surface of the sample. The spraying rate was 3.0 l/min.

The water washing proceeded in a countercurrent system from Rinsing (5) to Rinsing (1).

The reverse osmosis membrane used was a spiral-type RO module element DRA-80 (manufactured by Dicel Chemical Ltd.; effective membrane area: 1.1 $m^2$; a polysulfone-base composite membrane) and loaded into a plastic pressure-resistant vessel Model PV-0321 manufactured by the same company.

The reverse osmosis membrane was disposed as shown in FIGURE, the water in the fourth rinsing tank was sent to the reverse osmosis membrane by means of a pump under conditions such that the solution sending pressure was 7 $kg/cm^2$ and the solution sending flow rate was 1.8 l/min, the transmitted water was supplied to the fifth rinsing tank and the concentrated water was returned to the fourth rinsing tank. The amount of transmitted water into the fifth tank was from 250 to 400 ml/min.

Each processing solution had the following composition.

| | Tank Solution | Replenisher |
|---|---|---|
| **Color Developer** | | |
| Water | 800 ml | 800 ml |
| Triethanolamine | 12.0 g | 12.0 g |
| Ethylenediaminetetraacetate | 3.0 g | 3.0 g |
| Disodium 4,5-dihydroxy-benzene-1,3-disulfonate | 0.5 g | 0.5 g |
| Potassium chloride | 15.8 g | — |
| Potassium bromide | 0.045 g | — |
| Sodium 2,2',6,6'-tetrasoidum-sulfonatoethyl-4, triazinylaminostilbene-2,2'-disulfonate | 5.0 g | 8.0 g |
| Sodium sulfite | 0.05 g | 0.1 g |
| Disodium-N,N-bis(sulfonato-ethyl) hydroxylamine | 10.0 g | 14.0 g |
| N-Ethyl-N-(β-methanesulfon-amidoethyl)-3-methyl-4-amino-aniline · 3/2 sulfate monohydrate | 6.0 g | 18.5 g |
| Potassium carbonate | 26.3 g | 26.3 g |
| Water to make | 1,000 ml | 1,000 ml |
| pH (25° C., adjusted with potassium hydroxide | 10.35 | 12.80 |
| **Bleach-Fixing Solution** | | |
| Water | 500 ml | 500 ml |
| Ammonium thiosulfate (75%) | 80 ml | 160 ml |
| Ethylenediaminetetraacetic acid | 4.4 g | 8.0 g |
| Ammonium ethylenediamine-tetraacetato iron (III) dihydrate | 62.0 g | 124.0 g |
| Ammonium sulfite monohydrate | 58.0 g | 116.0 g |
| Ammonium bromide | 10.0 g | 20.0 g |
| Monoguanidine of formula (I) | 0.04 mol | 0.09 mol |
| Acetic acid (50%) | 66.0 ml | 132.0 g |
| Nitric acid (67%) | 18.29 g | 36.58 g |
| Water to make | 1,000 ml | 1,000 ml |
| pH (25° C., adjusted with nitric acid) | 5.00 | 4.80 |
| **Rinsing Solution** | | |
| The tank solution and the replenisher were the same. Ion exchanged water (containing 3 ppm or less of each of calcium and magnesium) | | |

For comparison with the monoguanidine of formula (I) used in the present invention, solutions prepared by adding no monoguanidine or incorporating the following Comparative Compound-1, Comparative Compound-2, Comparative Compound-3 or Comparative Compound-4 in the above-described processing formulation of the bleach-fixing solution were also examined.

Comparative Compound-1

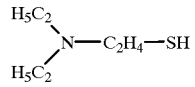

-continued

Comparative Compound-2

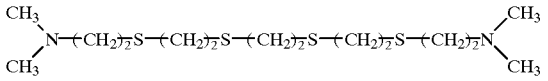

Comparative Compound-3

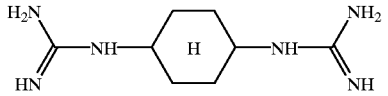

Comparative Compound-4

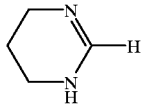

The samples obtained by subjecting Sample 100 to various processings were evaluated on the amount of developing agent remaining in the light-sensitive material after the processing, on the stains after aging and on the discoloration due to aging under heat and humidity.

(Determination of Amount of Residual Developing Agent)

Each sample processed as above was, after removing the excess solution attaching to the layer surface of the light-sensitive material, placed in acetic acid and ethyl acetate and the amount of residual color developing agent was measured.

(Evaluation of Stains)

The samples (for sensitometry) after the processing were held in a thermo-hygrostat where the temperature and the humidity were adjusted to 50° C. and 70%, respectively, for 14 days and then the reflection on the white background of each sample was measured using a spectrophotometer (Model 3410, manufactured by Hitachi, Ltd.). The degree of stains was evaluated by the increase in the absorption value at 430 nm between before and after the storage.

(Evaluation of Discoloration Due to Heat and Humidity)

The samples (for sensitometry) after the processing were allowed to stand in a thermo-hygrostat where the temperatureand the humidity were adjusted to 80° C. and 70%, respectively. Before and after the storage, the density at the maximum density part was measured using a Fuji standard densitometer (FSD-103, manufactured by Fuji Photo Film Co., Ltd.) and the difference therebetween was evaluated as the discoloration size.

The results obtained are shown in Table 1 below.

TABLE 1

| Sample No. | Compound | Amount of residual developing agent ($\mu$mol/m$^2$) | Stain | Discoloration due to heat and humidity |
|---|---|---|---|---|
| 1 (Comparison) | none | 35.1 | 0.060 | 0.25 |
| 2 (Comparison) | Comparative Compound-1 | 33.2 | 0.060 | 0.30 |
| 3 (Comparison) | 2 | 32.7 | 0.058 | 0.24 |
| 4 (Comparison) | 3 | 17.6 | 0.051 | 0.11 |
| 5 (Comparison) | 4 | 14.1 | 0.047 | 0.15 |
| 6 (Invention) | Compound-1 | 7.2 | 0.033 | 0.03 |
| 7 (Invention) | 2 | 9.1 | 0.037 | 0.03 |
| 8 (Invention) | 4 | 10.0 | 0.041 | 0.02 |
| 9 (Invention) | 9 | 9.2 | 0.038 | 0.02 |
| 10 (Invention) | 13 | 11.3 | 0.042 | 0.03 |
| 11 (Invention) | 16 | 10.7 | 0.041 | 0.04 |

TABLE 1-continued

| Sample No. | Compound | Amount of residual developing agent ($\mu$mol/m$^2$) | Stain | Discoloration due to heat and humidity |
|---|---|---|---|---|
| 12 (Invention) | 18 | 11.7 | 0.043 | 0.02 |
| 13 (Invention) | 20 | 8.3 | 0.041 | 0.02 |
| 14 (Invention) | 21 | 9.1 | 0.043 | 0.03 |
| 15 (Invention) | 22 | 9.2 | 0.043 | 0.03 |

As is clear from Table 1, even in the low-replenishing, ultra-rapid processing, when the compound represented by formula (I) of the present invention was present, the amount of residual developing agent and the stain were improved and the discoloration due to humidity and heat was kept at a good level. On the other hand, in Comparative Examples, all evaluations were inferior to those of the present invention.

EXAMPLE 2

Samples were prepared and processed in the same manner as in Example 1 except that the changes only of the following processing conditions ((1) to (3)) were made in the processing of Example 1.

| (1) Processing Step | Temperature (° C.) | Time (sec.) | Replenisher* (ml) | Tank Volume (l) |
|---|---|---|---|---|
| Color development | 38 | 45 | 35 | 6.0 |
| Bleach-fixing | 38 | 45 | 35 | 4.0 |
| Rinsing (1) | 40 | 4 | — | 1.7 |
| Rinsing (2) | 40 | 4 | — | 1.2 |
| Rinsing (3) | 40 | 4 | — | 1.2 |
| Rinsing (4) | 40 | 4 | — | 1.2 |
| Rinsing (5) | 40 | 6 | 70 | 1.7 |
| Drying | 70 to 80 | 30 | (wind velocity: 10 m/sec) | |

*: Replenishing amount was shown by the amount per 1 m$^2$ of the light-sensitive material.

(2) Each processing solution had the following composition.

Color Developer

| | Tank Solution | Replenisher |
|---|---|---|
| Water | 900 ml | 900 ml |
| Triethanolamine | 4.4 g | 12.0 g |
| Ethylenediaminetetraacetate | 2.0 g | 3.0 g |
| Disodium 4,5-dihydroxy-benzene-1,3-disulfonate | 0.2 g | 0.5 g |
| Potassium chloride | 10.0 g | 14.0 g |
| Potassium bromide | 0.04 g | 0.04 g |
| Sodium 2,2',6,6'-tetrasoidum-sulfonatoethyl-4, triazinylaminostilbene-2,2'-disulfonate | 3.0 g | 8.0 g |
| Sodium sulfite | 0.15 g | 0.2 g |
| Disodium-N,N-bis(sulfonato-ethyl) hydroxylamine | 10.0 g | 22.0 g |
| N-Ethyl-N-(β-methanesulfon-amidoethyl)-3-methyl-4-amino-aniline · 3/2 sulfate monohydrate | 5.0 g | 15.5 g |
| Potassium carbonate | 13.3 g | 26.3 g |
| Water to make | 1,000 ml | 1,000 ml |

-continued

| | | |
|---|---|---|
| pH (25° C., adjusted with potassium hydroxide | 10.00 | 12.50 |

(3) The monoguanidine incorporated into the bleach-fixing solution formulation was Compound 1, 13, 20 or 22.

Each sample after the above-described processing was evaluated on respective items in the same manner as in Example 1. The results obtained are shown in Table 2 below.

TABLE 2

| Sample No. | Compound | Amount of residual developing agent ($\mu$mol/m$^2$) | Stain | Discoloration due to heat and humidity |
|---|---|---|---|---|
| 1 (Comparison) | none | 27.8 | 0.057 | 0.25 |
| 2 (Invention) | Compound-1 | 5.3 | 0.031 | 0.02 |
| 3 (Invention) | 13 | 9.2 | 0.042 | 0.04 |
| 4 (Invention) | 20 | 7.5 | 0.037 | 0.01 |
| 5 (Invention) | 22 | 9.3 | 0.041 | 0.02 |

As is clear from Table 2, the monoguanidines represented by formula (I) of the present invention provided a great effect even in a system where the development time was 45 seconds.

EXAMPLE 3

The test was conducted in the same manner as in Example 1 except that, in order to examine the dependency on the amount of residual color developing agent in the present invention, the amount of color developing agent was changed to 8, 13 or 17 mmol/l and samples immediately after the initiation of processing were tested. Compound-1 was used as a monoguanidine of formula (I) and the solution free of the monoguanidine of formula (I) was also examined for the purpose of comparison of the effect. Further, the dependency of the maximum density on the color development time was examined and the time required for accomplishing an image (time until the density reached 93% of the final density) was evaluated. The time for accomplishing an image and the amount of residual developing agent determined in the same manner as in Example 1 are shown Table 3 below.

TABLE 3

| Amount of developing agent | Time for accomplishing | Amount of residual developing agent ($\mu$mol/m$^2$) | |
|---|---|---|---|
| (mmol/l) | image (sec) | none | Compound-1 |
| 8 | 24 | 7.2 | 5.8 |
| 13 | 19 | 11 | 6.0 |
| 17 | 15 | 18 | 8.9 |

The increase in the amount of the developing agent is a large factor for achieving rapid processing, and when the case was so, as seen in Table 3, the amount of residual developing agent was reduced according to the present invention, revealing a great effect of the compound of the present invention.

Further, the same evaluation as above was made by changing the color development temperature in Example 1 to 30° C., 40° C. or 50° C., and also in this case, the compound of the present invention was found to provide a great effect in preventing stains at the time of temperature elevation which is important in achieving rapid processing.

EXAMPLE 4

In order to examine the dependency on the amount of chemicals, Samples 101 and 102 were prepared in the same manner as in Example 1 except for changing the amount of gelatin in Sample 100 of Example 1 as shown in Table 4 below. The amount of gelatin and the alkali consumption in each coated layer are shown in Table 4. Each sample was processed in the same manner as in Example 1 except for using Compound-1 as the compound represented by formula (I) of the present invention. After the processing, each sample was evaluated on the amount of residual developing agent and on the stain in the same manner as in Example 1. The results obtained are shown in Table 5 below.

TABLE 4

| | Sample 100 (g/m$^2$) | Sample 101 (g/m$^2$) | Sample 102 (g/m$^2$) |
|---|---|---|---|
| First layer | (1.29) | 1.12 | 1.33 |
| Second layer | (1.00) | 0.88 | 1.07 |
| Third layer | (1.21) | 1.00 | 1.22 |
| Fourth layer | (0.71) | 0.68 | 0.74 |
| Fifth layer | (1.03) | 0.76 | 1.10 |
| Sixth layer | (0.56) | 0.50 | 0.60 |
| Seventh layer | (1.00) | 0.81 | 1.06 |
| Total | 6.8 | 5.75 | 7.12 |
| Alkali consumption (mmol/m$^2$) | 2.9 | 2.6 | 3.1 |

TABLE 5

| | Amount of residual developing agent ($\mu$mol/m$^2$) | | Stain | |
|---|---|---|---|---|
| Sample No. | none | Compound-1 | none | Compound-1 |
| 100 | 35.1 | 7.2 | 0.060 | 0.033 |
| 101 | 27.9 | 5.0 | 0.058 | 0.027 |
| 102 | 39.1 | 8.8 | 0.072 | 0.038 |

As is seen from Table 5, the monoguanidines represented by formula (I) of the present invention provided a great effect the same as in Example 1. It is also seen that when the gelatin coated amount was 6.8 g/m$^2$ or less and the alkali consumption was 2.9 mmol/m$^2$ or less, good results were obtained in the evaluation on the amount of residual developing agent and on the stain.

EXAMPLE 5

The processing was conducted using Sample 100 of Example 1 in the same manner as in Example 1 except for excluding sodium 2,2',6,6'-tetrasoidumsulfonatoethyl-4,4'-triazinylaminostilbene-2,2'-disulfonate from the color developer of Example 1 (Processing No. 501). Compound-20 was used as the compound represented by formula (I) of the present invention and comparison was made with the case free of the compound of formula (I). Samples 502 to 505 were prepared by processing Sample 100 of Example 1 according to Processing No. 501 except for adding aminostilbene Compound F-3, 6 or 7 to the color developer in Processing No. 501. Each sample was evaluated on the amount of residual developing agent according to the method described in Example 1 and each sample immediately after the processing was determined on the absorbance (at 450 nm) of the spectral reflection on the non-image area (measured by Model 3410, manufactured by Hitachi, Ltd.). The results obtained are shown in Table 6 below. The absorbance measured here corresponds to the absorption spectrum of the sensitizing dye used in the BL layer and the stain attributable to the dye was evaluated.

TABLE 6

| | Amount of residual developing agent ($\mu$mol/m$^2$) | | Absorbance (at 450 nm) | |
|---|---|---|---|---|
| Processing No. | none | Compound 20 | none | Compound 20 |
| Example 1 | 35.1 | 8.3 | 0.060 | 0.041 |
| Sample 501 | 36.2 | 8.1 | 0.086 | 0.077 |
| Sample 502 (F-3) | 35.8 | 8.2 | 0.063 | 0.041 |
| Sample 503 (F-6) | 35.4 | 8.4 | 0.064 | 0.042 |
| Sample 504 (F-7) | 35.6 | 8.3 | 0.059 | 0.040 |

As is seen from Table 6, in a system where the stilbene compound and the compound represented by formula (I) of the present invention were present together, removal of the sensitizing dye was made more sufficiently and the effect of the present invention was more remarkable.

EXAMPLE 6

(Preparation of Support)

Into a low density polyethylene of MFR-3, 30 wt % of titanium dioxide was added and 3.0 wt % on a titanium dioxide basis of zinc stearate was incorporated, and the mixture was kneaded together with ultramarine (DV-1, produced by Daiichi Kasei Kogyo KK) in a banbury mixer and melt extruded. The titanium oxide used was verified through an electron microscope that the thickness was from 0.15 to 0.35 $\mu$m and the coating amount of hydrated aluminum oxide in the form of $Al_2O_3$ was 75 wt % based on the titanium dioxide.

A paper base weighed 170 g/m$^2$ was subjected to corona treatment at 10 kVA and thereon the above-described polyethylene composition containing 30 wt % of titanium dioxide and polyethylene containing no titanium dioxide but containing ultramarine were melt extruded at 320° C. using a multi-layer extrusion coating die to provide a polyethylene laminate layer consisting of an upper layer having a layer thickness of 18 $\mu$m (30 wt %) and a lower layer of 15 $\mu$m (0 wt %) (the lower layer is a layer on the paper base side). The surface of the polyethylene laminate layer was subjected to glow discharge treatment.

(Preparation of Light-Sensitive Material 601)

On the reflective support obtained above, various photographic constituent layers were coated to prepare a multilayer color printing paper (601) having the following layer structure. The coating solutions were prepared as follows.

Preparation of Coating Solution for Third Layer

Into 32.5 g of Solvent (Solv-6-3), 97.5 g of Solvent (Solv-6-4), 65.0 g of Solvent (Solv-6-6) and 110 ml of ethyl acetate, 40.0 g of Magenta Coupler (ExM6), 40.0 g of Ultraviolet absorbent (UV-6-2), 7.5 g of Dye Image Stabilizer (Cpd-6-2), 25.0 g of Dye Image Stabilizer (Cpd-6-5), 2.5 g of Dye Image Stabilizer (Cpd-6-6), 20.0 g of Dye Image Stabilizer (Cpd-6-7), 2.5 g of Dye Image Stabilizer (Cpd-6-8) and 5.0 g of Dye Image Stabilizer (Cpd-6-10) were dissolved, and the resulting solution was emulsion-dispersed in 1,500 g of a 7% aqueous gelatin solution containing 90 ml of a 10% sodium dodecylbenzenesulfonate to prepare Emulsified Dispersion A-6. Separately, Silver Chlorobromide Emulsion B-1 (cubic; a ⅓ mixture (by mol as silver) of a large size emulsion having an average grain size of 0.55 $\mu$m and a small size emulsion having an average grain size of 0.39 $\mu$m; coefficients of variation in the grain size distribution being 0.08 and 0.06, respectively; each size emulsion containing 0.8 mol % of silver bromide localized on a part of the surface of a grain comprising silver chloride as a substrate; 0.1 mg/mol-Ag in total of potassium hexachloroiridate(IV) and 1.0 mg/mol-Ag in total of potassium ferrocyanide being incorporated into the inside of the grain and into the silver bromide localized phase) was prepared. To the emulsion, Green-Sensitive Sensitizing Dyes D, E and F shown below were added in an amount of $3.0\times10^{-4}$ mol/mol-Ag, $4.0\times10^{-5}$ mol/mol-Ag and $2.0\times10^{-4}$ mol/mol-Ag, respectively, for the large size emulsion and in an amount of $3.6\times10^{-4}$ mol/mol-Ag, $7.0\times10^{-5}$ mol/mol-Ag and $2.8\times10^{-4}$ mol/mol-Ag, respectively, for the small size emulsion. Then, the emulsion was subjected to optimal chemical sensitization by adding a sulfur sensitizer and a gold sensitizer in the presence of a decomposed product of a nucleic acid. Emulsified Dispersion A-6 prepared above and Silver Chlorobromide Emulsion B-1 were mixed and dissolved to prepare the coating solution for the third layer having the composition described later.

The coating solutions for the first to seventh layers were prepared in the same manner as the coating solution for the third layer. In each layer, 1-oxy-3,5-dichloro-s-triazine sodium salt was used as a gelatin hardening agent.

Further, to each layer, Cpd-6-12 and Cpd-6-13 were added to give the total amount of 25.0 mg/m$^2$ and 50.0 mg/m$^2$, respectively.

The silver chlorobromide emulsion in each light-sensitive emulsion layer was adjusted on the size according to the same preparation method as used for Silver Chlorobromide Emulsion B-1 and therein, the following spectral sensitizing dyes were used.

Blue-Sensitive Emulsion Layer

Sensitizing Dye A

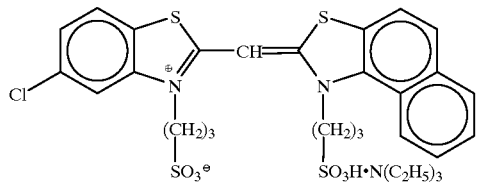

Sensitizing Dye B

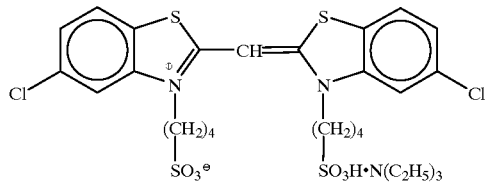

-continued

Sensitizing Dye C

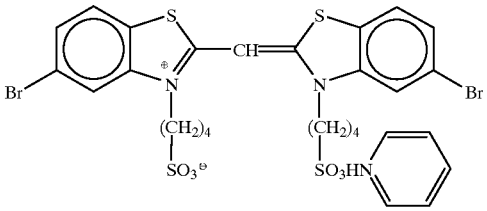

(Each sensitizing dye was added in an amount of $1.4\times10^{-4}$ mol for the large size emulsion and in an amount of $1.7\times10^{-4}$ mol for the small size emulsion, per mol of silver halide.)

Green-Sensitive Emulsion Layer

Sensitizing Dye D

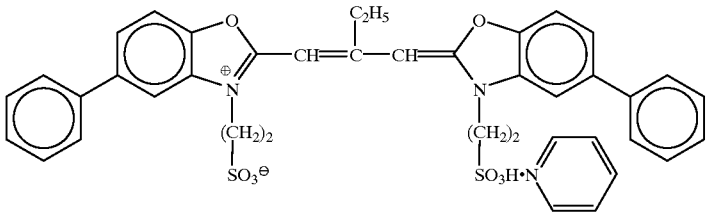

Sensitizing Dye E

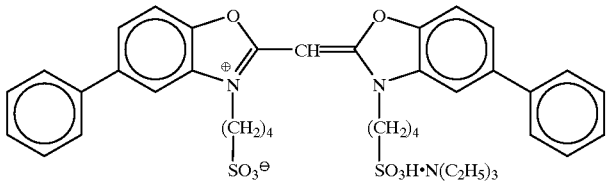

Sensitizing Dye F

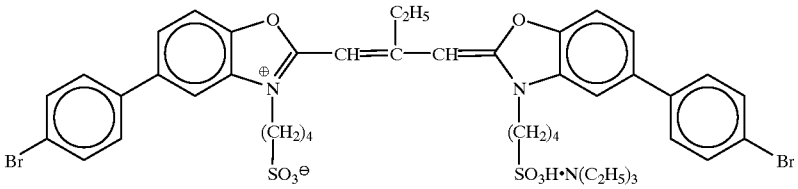

(Sensitizing Dye D was added in an amount of $3.0\times10^{-4}$ mol for the large size emulsion and in an amount of $3.6\times10^{-4}$ mol for the small size emulsion, per mol of silver halide; Sensitizing Dye E was added in an amount of $4.0\times10^{-5}$ mol for the large size emulsion and in an amount of $7.0\times10^{-5}$ mol for the small size emulsion, per mol of silver halide; and Sensitizing Dye F was added in an amount of $2.0\times10^{-4}$ mol for the large size emulsion and in an amount of $2.8\times10^{-4}$ mol for the small size emulsion, per mol of silver halide.)

Red-Sensitive Emulsion Layer

Sensitizing Dye G

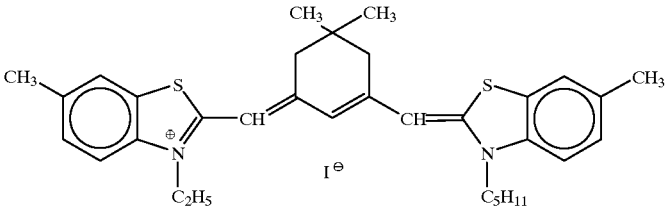

-continued

Sensitizing Dye H

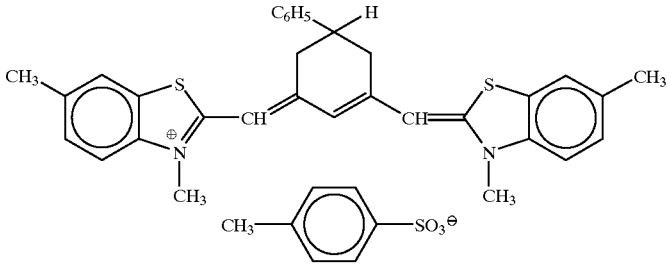

(Sensitizing Dye G was added in an amount of $4.0\times10^{-5}$ mol for the large size emulsion and in an amount of $5.0\times10^{-5}$ mol for the small size emulsion, per mol of silver halide; and Sensitizing Dye H was added in an amount of $5.0\times10^{-5}$ mol for the large size emulsion and in an amount of $6.0\times10^{-5}$ mol for the small size emulsion, per mol of silver halide.)

Further, the following compound was added to the red-sensitive silver halide emulsion in an amount of $2.6\times10^{-3}$ mol per mol of silver halide.

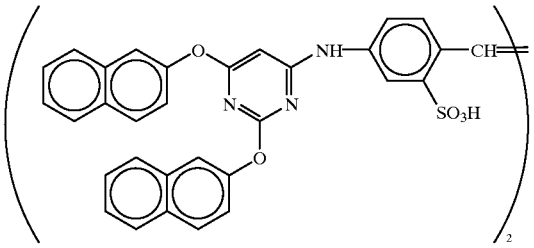

Furthermore, to the blue-sensitive emulsion layer, the green-sensitive emulsion layer and the red-sensitive emulsion layer, 1-(5-methylureidophenyl)-5-mercaptotetrazole was added in an amount of $8.5\times10^{-4}$ mol, $3.0\times10^{-3}$ mol and $2.5\times10^{-4}$ mol, respectively, per mol of silver halide.

To the blue sensitive emulsion layer and the green-sensitive emulsion layer, 4-hydroxy-6-methyl-1,3,3a,7-tetrazaindene was added in an amount of $1\times10^{-4}$ mol and $2\times10^{-4}$ mol, respectively, per mol of silver halide.

For the purpose of preventing irradiation, the following dyes (in the parentheses, the coating amounts are shown) were added to the emulsion layers.

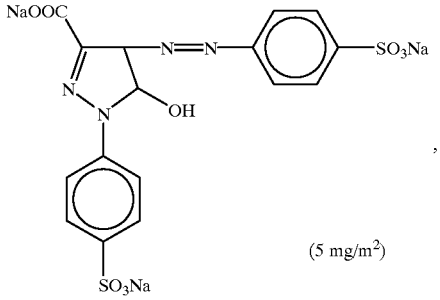

(5 mg/m$^2$)

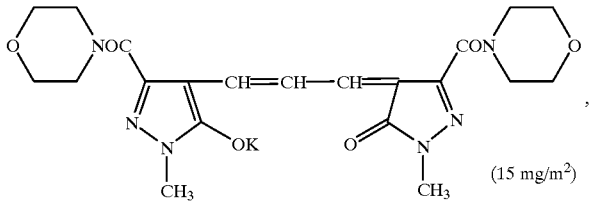

(15 mg/m$^2$)

-continued

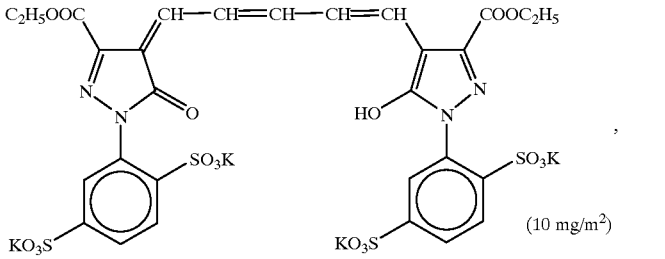

(10 mg/m$^2$)

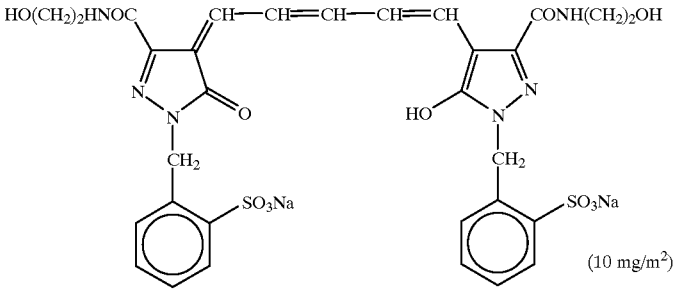

(10 mg/m$^2$)

and

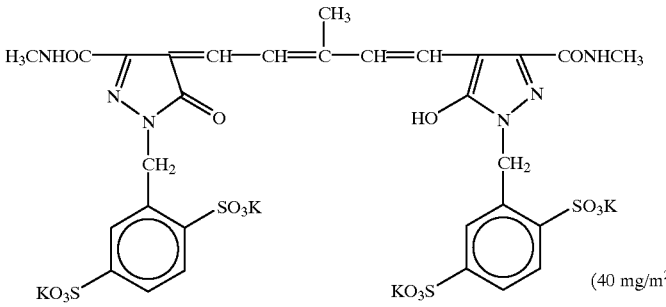

(40 mg/m$^2$)

(Layer Structure)

The composition of each layer is shown below. The numerals show the coating amount (g/m$^2$). With respect to the silver halide emulsion, the numerals show the coating amount calculated in terms of silver.

| | |
|---|---|
| Support (A) | |
| containing a bluish dye (ultramarine) in the resin layer on the first layer side | |
| First Layer (Blue-sensitive Emulsion Layer) | |
| Silver Chlorobromide Emulsion A-1 (cubic; a 5:5 mixture (by mol as silver) of a large size emulsion having an average grain size of 0.88 μm and a small size emulsion having an average grain size of 0.70 μm; the coefficients of variation in the grain size distribution being 0.08 and 0.10, respectively; each size emulsion containing 0.3 mol % of silver bromide localized on a part of the support of a grain comprising silver chloride as a substrate; 0.1 mg/mol-Ag in total of potassium hexachloroiridate (IV) and 1.0 mg/mol-Ag in total of potassiuin ferrocyanide being incorporated into the inside of the grain and into the silver bromide localized phase) | 0.27 |
| Gelatin | 1.22 |
| Yellow Coupler (ExY6) | 0.79 |
| Dye Image Stabilizer (Cpd-6-1) | 0.08 |

-continued

| | |
|---|---|
| Dye Image Stabilizer (Cpd-6-2) | 0.04 |
| Dye Image Stabilizer (Cpd-6-3) | 0.08 |
| Dye Image Stabilizer (Cpd-6-5) | 0.01 |
| Solvent (Solv-6-1) | 0.13 |
| Solvent (Solv-6-5) | 0.13 |
| Second Layer (Color Mixing Preventing Layer) | |
| Gelatin | 0.90 |
| Color Mixing Inhibitor (Cpd-6-4) | 0.08 |
| Solvent (Solv-6-1) | 0.10 |
| Solvent (Solv-6-2) | 0.15 |
| Solvent (Solv-6-3) | 0.25 |
| Solvent (Solv-6-8) | 0.03 |
| Third Layer (Green-sensitive Emulsion Layer) | |
| Silver Chlorobromide Emulsion B-1 prepared above | 0.13 |
| Gelatin | 1.45 |
| Magenta Coupler (ExM6) | 0.16 |
| Ultraviolet Absorbent (UV-6-2) | 0.16 |
| Dye Image Stabilizer (Cpd-6-2) | 0.03 |
| Dye Image Stabilizer (Cpd-6-5) | 0.10 |
| Dye Image Stabilizer (Cpd-6-6) | 0.01 |
| Dye Image Stabilizer (Cpd-6-7) | 0.08 |
| Dye Image Stabilizer (Cpd-6-8) | 0.01 |
| Dye Image Stabilizer (Cpd-6-10) | 0.02 |
| Solvent (Solv-6-3) | 0.13 |
| Solvent (Solv-6-4) | 0.39 |
| Solvent (Solv-6-6) | 0.26 |
| Fourth Layer (Color Mixing Preventing Layer) | |
| Gelatin | 0.68 |

-continued

| | |
|---|---|
| Color Mixing Inhibitor (Cpd-6-4) | 0.06 |
| Solvent (Solv-6-1) | 0.07 |
| Solvent (Solv-6-2) | 0.11 |
| Solvent (Solv-6-3) | 0.18 |
| Solvent (Solv-6-8) | 0.02 |
| Fifth Layer (Red-sensitive Emulsion Layer) | |
| Silver Chlorobromide Emulsion C-1 (cubic; a 1:4 (by mol as silver) mixture of a large size emulsion having an average grain size of 0.50 μm and a small size emulsin having an average grain size of 0.41 μm; coefficients of variation in the grain size distribution being 0.09 and 0.11, respectively; each size emulsion containing 0.8 mol % of silver bromide localized on a part of the surface of a grain comprising silver chloride as a substrate; 0.3 mg/mol-Ag in total of potassium hexachloroiridate (IV) and 1.5 mg/mol-Ag in total of potassium ferrocyanide being incorporated into the inside of the grain and into the silver bromide localized phase) | 0.18 |
| Gelatin | 0.80 |
| Cyan Coupler (ExC6) | 0.33 |
| Ultraviolet Absorbent (UV-6-2) | 0.18 |
| Dye Image Stabilizer (Cpd-6-1) | 0.33 |
| Dye Image Stabilizer (Cpd-6-2) | 0.03 |
| Dye Image Stabilizer (Cpd-6-6) | 0.01 |
| Dye Image Stabilizer (Cpd-6-8) | 0.01 |
| Dye Image Stabilizer (Cpd-6-9) | 0.02 |
| Dye Image Stabilizer (Cpd-6-10) | 0.01 |
| Solvent (Solv-6-1) | 0.01 |
| Solvent (Solv-6-7) | 0.22 |
| Sixth Layer (Ultraviolet Absorbing Layer) | |
| Gelatin | 0.48 |

-continued

| | |
|---|---|
| Ultraviolet Absorbent (UV-6-1) | 0.38 |
| Dye Image Stabilizer (Cpd-6-5) | 0.01 |
| Dye Image Stabilizer (Cpd-6-7) | 0.05 |
| Solvent (Solv-6-9) | 0.05 |
| Seventh Layer (Protective Layer) | |
| Gelatin | 0.90 |
| Acryl-modified copolymer of polyvinyl alcohol (modification degree: 17%) | 0.05 |
| Liquid paraffin | 0.02 |
| Dye Image Stabilizer (Cpd-6-11) | 0.01 |

Yellow Coupler (ExY6)

A 1/1 mixture (by mol) of:

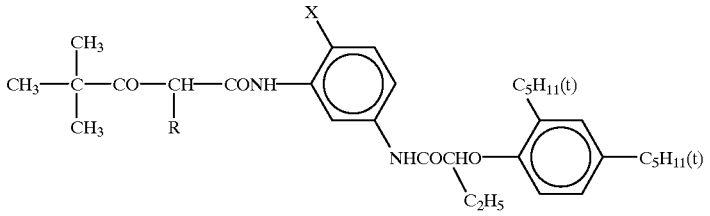

R =

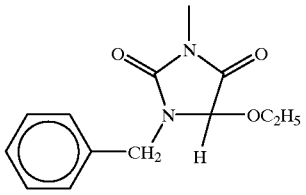

X = Cl and

R =

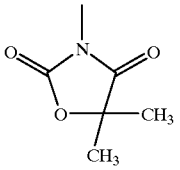

X = $OCH_3$

-continued
Magenta Coupler (ExM6)
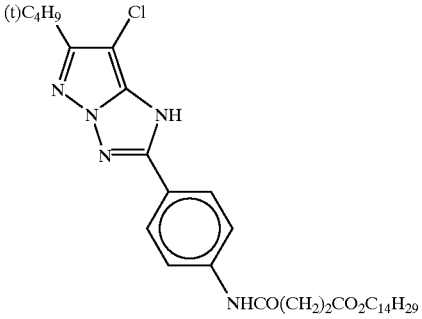
Cyan Coupler (ExC6)
A 25/75 mixture (by mol) of:
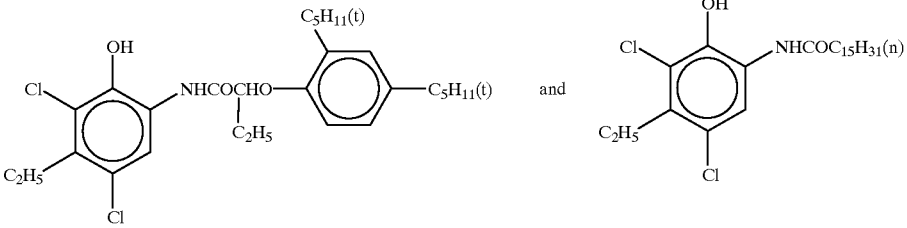
Dye Image Stabilizer (Cpd-6-1)
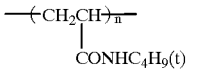
number average molecular weight: 60,000
Dye Image Stabilizer (Cpd-6-2)
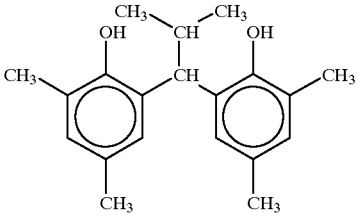
Dye Image Stabilizer (Cpd-6-3)
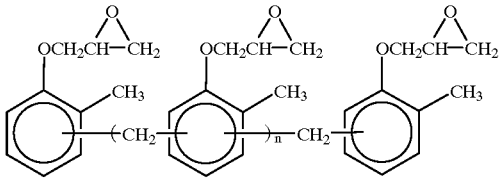
n = 7 to 8 (average)
Color Mixing Inhibitor (Cpd-6-4)
A 1/1/1 mixture (by weight) of:
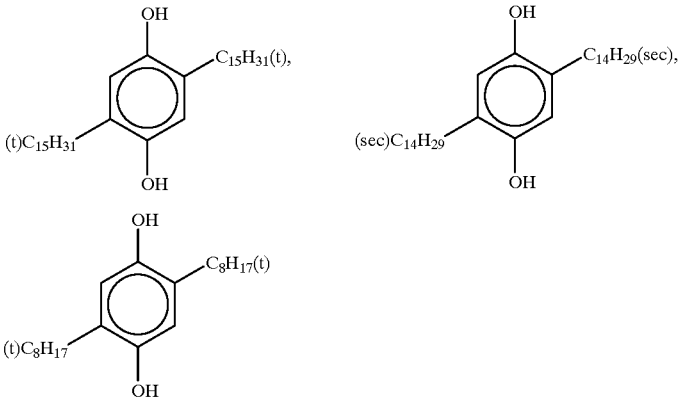

-continued
Dye Image Stabilizer (Cpd-6-5)
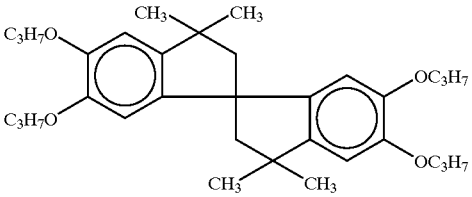
Dye Image Stabilizer (Cpd-6-6)
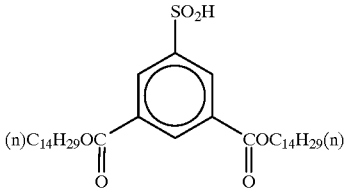
Dye Image Stabilizer (Cpd-6-7)
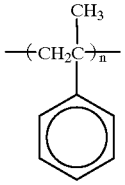
number average molecular weight: 600
Dye Image Stabilizer (Cpd-6-8)
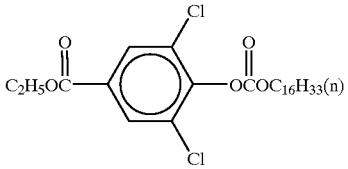
Dye Image Stabilizer (Cpd-6-9)
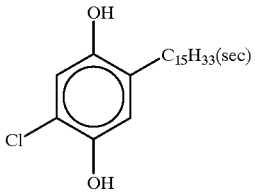
Dye Image Stabilizer (Cpd-6-10)
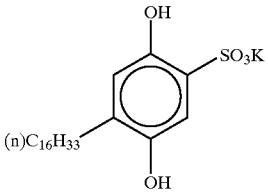
Dye Image Stabilizer (Cpd-6-11)
A 1/2/1 mixture (by weight) of:
(i)
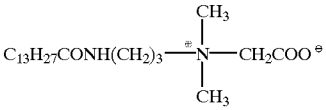
(ii)
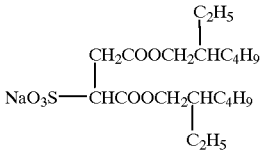
and
(iii)
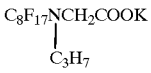
Antiseptic (Cpd-6-12)
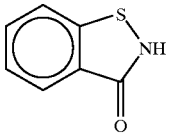
Antiseptic (Cpd-6-13)
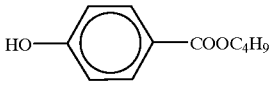
Ultraviolet Absorbent (UV-6-1)
A 1/2/2/3/1 mixture (by weight) of:
(iv)
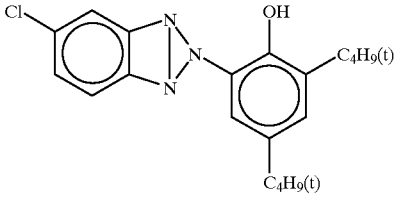
(v)
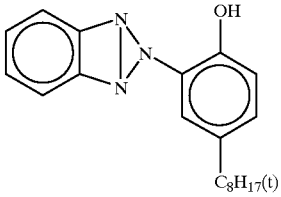

-continued
(vi)
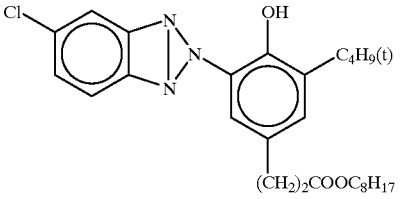
(vii)
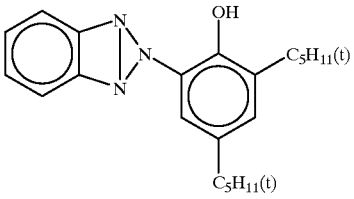
(viii)
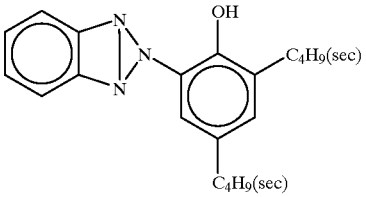
Ultraviolet Absorbent (UV-6-2)
A 2/3/4/1 mixture (by weight) of :
(iv)
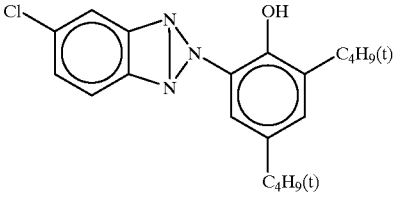
(x)
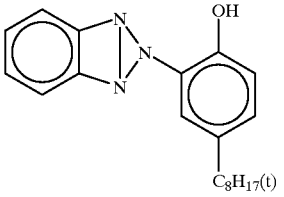
(xi)
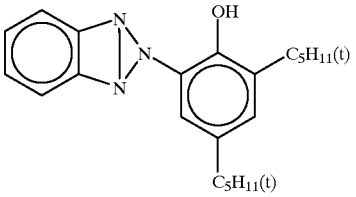
(xii)
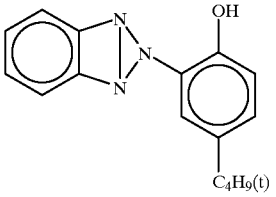
Solvent (Solv-6-1)
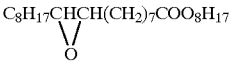
Solvent (Solv-6-2)
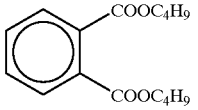
Solvent (Solv-6-3)
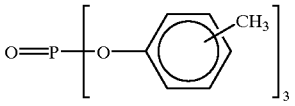
Solvent (Solv-6-4)
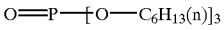
Solvent (Solv-6-5)
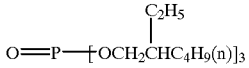
Solvent (Solv-6-6)
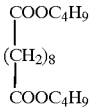
Solvent (Solv-6-7)
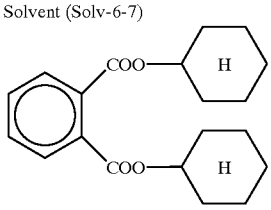
Solvent (Solv-6-8)
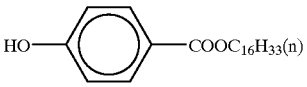

-continued

Solvent (Solv-6-9)

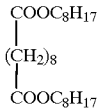

The light-sensitive material prepared was designated as Sample 601 and processed in the same manner as in Example 1 except for using Compound 1, 6 or 20 as the monoguanidine represented by formula (I) of the present invention in the processing of Example 1. Further, for comparison, Sample 601 was processed using no compound as the monoguanidine represented by formula (I) of the present invention. Each of processed samples was evaluated on the amount of residual developing agent and on the stain in the same manner as in Example 1. The results obtained are shown in Table 7.

TABLE 7

| Light-sensitive Material No. | Compound No. | Amount of Residual Developing Agent ($\mu$mol/m$^2$) | Stain |
|---|---|---|---|
| 601 | none | 34.8 | 0.056 |
| 601 | Compound-1 | 6.9 | 0.030 |
| 601 | Compound-16 | 10.3 | 0.034 |
| 601 | Compound-20 | 7.1 | 0.032 |

As is seen from Table 7, even in the examination of this light-sensitive material (Sample 601), when the compound of the present invention was used, the amount of the residual developing agent in samples after the processing was reduced, good acceleration effect on the washing out of the dyes used was exhibited, reddish stains were less generated and the level of improvement with respect to the total stains was further higher.

According to the present invention, a method for processing a silver halide color photographic light-sensitive material is provided where, in subjecting a silver halide color photographic light-sensitive material to ultra-rapid processing using a color developing agent with a low replenishing amount, remaining of the color developing agent in the light-sensitive material after the processing can be reduced, generation of stains is suppressed even after a long-term storage and an image undergoing less discoloration can be obtained even when the light-sensitive material is stored under high temperature and high humidity conditions. Further provided is a desilvering processing composition suitable for ultra-rapid processing with a low replenishing amount, capable of reducing the remaining of a developing agent in the processed light-sensitive material, causing little stains on the white background even after a long-term storage and capable of providing a color image undergoing less discoloration even after storage under high temperature and high humidity conditions.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic light-sensitive material comprising a support having thereon at least one light-sensitive silver halide emulsion layer, said method comprising the steps of: exposing said light-sensitive material; color developing said light-sensitive material; and desilvering said light-sensitive material, said desilvering step comprising processing said light-sensitive material with a desilvering processing solution containing at least one monoguanidine compound represented by formula (I) or a salt thereof:

(I)

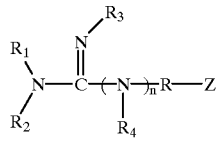

wherein Z represents —$NR_5(R_6)$ or —$OR_7$, R represents an alkylene group, n represents 1, $R_1$, $R_2$, $R_3$, $R_4$, $R_5$ and $R_6$ each independently represents a hydrogen atom, an aliphatic group or an aromatic group, and $R_7$ represents an aliphatic group or an aromatic group, provided that any two of $R_1$, $R_2$, $R_3$ and $R_4$ may be combined with each other to form a ring, that the total carbon number of $R_5$ and $R_6$ is from 4 to 20 and that $R_5$ and $R_6$ may form a ring.

2. A method for processing a silver halide color photographic light-sensitive material as claimed in claim 1, wherein said silver halide color photographic light-sensitive material is processed in the presence of a stilbene fluorescent brightening agent.

3. A method for processing a silver halide color photographic light-sensitive material as claimed in claim 1, wherein the total processing time from the initiation of development to the completion of drying is from 10 to 120 seconds, a color developer contains a developing agent in an amount of from 12 to 200 mmol/l and a color development temperature is from 40 to 50° C.

4. A method for processing a silver halide color photographic light-sensitive material as claimed in claim 2, wherein the total processing time from the initiation of development to the completion of drying is from 10 to 120 seconds, a color developer contains a developing agent in an amount of from 12 to 200 mmol/l and a color development temperature is from 40 to 50° C.

5. A method for processing a silver halide color photographic light-sensitive material as claimed in claim 1, wherein said light-sensitive silver halide emulsion layer comprises silver halide grains having a silver chloride content of 98 mol % or more, said silver halide color photographic light-sensitive material has a hydrophilic colloid coverage of from 2 to 6.8 g/m$^2$ and an alkali consumption of from 1.0 to 2.9 mmol/m$^2$, and the color development processing time is from 5 to 30 seconds.

6. A method for processing a silver halide color photographic light-sensitive material as claimed in claim 2, wherein said light-sensitive silver halide emulsion layer comprises silver halide grains having a silver chloride content of 98 mol % or more, said silver halide color photographic light-sensitive material has a hydrophilic colloid coverage of from 2 to 6.8 g/m$^2$ and an alkali consumption of from 1.0 to 2.9 mmol/m$^2$, and the color development processing time is from 5 to 30 seconds.

7. A method for processing a silver halide color photographic light-sensitive material as claimed in claim 1, wherein in formula (I), Z represents —$NR_5(R_6)$, R represents an alkylene group having from 2 to 6 carbon atoms, n is 1, $R_1$, $R_2$, $R_3$ and $R_4$ each represents independently a hydrogen atom or an aliphatic group having from 1 to 7 carbon atoms, $R_5$ and $R_6$ each represents independently a hydrogen atom or an aliphatic group having from 1 to 7 carbon atoms, and the total carbon number of $R_5$ and $R_6$ is from 4 to 10.

8. A method for processing a silver halide color photographic light-sensitive material as claimed in claim 7, wherein in formula (I), $R_1$, $R_2$, $R_3$ and $R_4$ each represents independently a hydrogen atom or a lower alkyl group having from 1 to 4 carbon atoms, $R_5$ and $R_6$ each represents independently an alkyl group having from 1 to 6 carbon atoms, and the total carbon number of $R_5$ and $R_6$ is from 4 to 10.

9. A method for processing a silver halide color photographic light-sensitive material as claimed in claim 8, wherein in formula (I), $R_1$, $R_2$, $R_3$ and $R_4$ each represents a hydrogen atom, $R_5$ and $R_6$ are combined with each other to form a ring, and the total carbon number of $R_5$ and $R_6$ is from 4 to 6.

10. A method for processing a silver halide color photographic light-sensitive material as claimed in claim 1, wherein said compound represented by formula (I) or a salt thereof is contained in said desilvering processing solution in an amount of from 0.005 to 0.5 mmol/l.

11. A method for processing a silver halide color photographic light-sensitive material as claimed in claim 10, wherein said compound represented by formula (I) or a salt thereof is contained in said desilvering processing solution in an amount of from 0.01 to 0.1 mmol/l.

12. A method for processing a silver halide color photographic light-sensitive material as claimed in claim 2, wherein said stilbene fluorescent brightening agent is contained in said desilvering processing solution in an amount of from $1\times10^{-4}$ to $5\times10^{-2}$ mol/l.

13. A method for processing a silver halide color photographic light-sensitive material as claimed in claim 1, wherein a stilbene fluorescent brightening agent is contained in said light-sensitive material in an amount of from 10 to 100 mg/m$^2$.

14. A method for processing a silver halide color photographic light-sensitive material as claimed in claim 3, wherein said compound represented by formula (I) or a salt thereof is contained in said desilvering processing solution in an amount of from 0.005 to 0.5 mmol/l.

15. A method for processing a silver halide color photographic light-sensitive material as claimed in claim 4, wherein said compound represented by formula (I) or a salt thereof is contained in said desilvering processing solution in an amount of from 0.005 to 0.5 mmol/l.

16. A method for processing a silver halide color photographic light-sensitive material as claimed in claim 15, wherein said stilbene fluorescent brightening agent is contained in said desilvering processing solution in an amount of from $1\times10^{-4}$ to $5\times10^{-2}$ mol/l.

17. A method for processing a silver halide color photographic light-sensitive material comprising a support having thereon at least one light-sensitive silver halide emulsion layer, said method comprising the steps of: exposing said light-sensitive material; color developing said light-sensitive material; and desilvering said light-sensitive material, said desilvering step comprising processing said light-sensitive material with a desilvering processing solution containing at least one compound represented by the formula

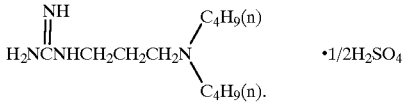

* * * * *